US006644889B2

(12) United States Patent
Hartman

(10) Patent No.: US 6,644,889 B2
(45) **Date of Patent: *Nov. 11, 2003**

(54) HEADWALL FOR DRAIN PIPE

(75) Inventor: Henry B. Hartman, Pittsburgh, PA (US)

(73) Assignee: Hartman EW, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/062,195

(22) Filed: Jan. 31, 2002

(65) Prior Publication Data

US 2002/0127061 A1 Sep. 12, 2002

Related U.S. Application Data

(63) Continuation-in-part of application No. 09/787,556, filed as application No. PCT/US99/24095 on Oct. 18, 1999, now Pat. No. 6,422,788.

(60) Provisional application No. 60/105,121, filed on Oct. 21, 1998.

(51) Int. Cl.[7] ..... E01F 5/00

(52) U.S. Cl. ..... 405/125

(58) Field of Search ..... 405/124, 125, 405/126, 127, 36, 39, 40, 42

(56) References Cited

U.S. PATENT DOCUMENTS

| | | | | |
|---|---|---|---|---|
| 1,098,766 A | | 6/1914 | Scully et al. | 405/125 |
| 1,664,503 A | | 4/1928 | Cornell | 405/125 |
| 2,636,352 A | | 4/1953 | Alger | 405/125 |
| D180,410 S | | 6/1957 | Mowbray | D23/259 |
| 2,958,200 A | | 11/1960 | Russell | 405/125 |
| 3,779,021 A | | 12/1973 | Green | 405/125 |
| 4,537,529 A | | 8/1985 | FitzSimons | 405/125 |
| 4,723,871 A | | 2/1988 | Roscoe | 405/125 |
| 5,425,600 A | | 6/1995 | Gordon | 405/284 |
| 5,551,798 A | | 9/1996 | Goodreau | 405/124 |
| 6,334,953 B1 | | 1/2002 | Singleton | 405/36 |
| 6,422,788 B1 | * | 7/2002 | Hartman | 405/125 |

FOREIGN PATENT DOCUMENTS

| | | |
|---|---|---|
| GB | 2076867 | 12/1981 |

* cited by examiner

*Primary Examiner*—Heather Shackelford
*Assistant Examiner*—Frederick Lagman
(74) *Attorney, Agent, or Firm*—Webb Ziesenheim Logsdon Orkin & Hanson, P.C.

(57) ABSTRACT

A sectional headwall (10) for a drain pipe (72) includes a unitary base member (12), a unitary sectional member (14) positioned on top of the base member (12), and a unitary lid member (16) positioned on top of the sectional member (14). The unitary base member (12) includes two longitudinally extending walls (42,44) and two end walls (46). The base member (12) further includes a sleeve (48) extending between and connecting the longitudinal walls (42,44). The sleeve (48) defines an aperture (50) extending through the longitudinal walls (42,44) for receiving a drain pipe (72). A drain pipe adapter (80) may be inserted into the aperture (50) to accommodate different sized drain pipes (72).

54 Claims, 14 Drawing Sheets

HEADWALL FOR DRAIN PIPE

CROSS-REFERENCE TO RELATED APPLICATION

This application is a Continuation-in-Part of U.S. application Ser. No. 09/787,556 filed Mar. 19, 2001, now U.S. Pat. No. 6,422,788, which is the national phase of PCT Application No. PCT/US99/24095, filed Oct. 18, 1999 which claims priority to U.S. Provisional Application Ser. No. 60/105,121, filed Oct. 21, 1998.

BACKGROUND OF THE INVENTION

1. Field of the Invention

The present invention relates to headwalls for drain pipes and, more particularly, to sectional headwalls for drain pipes.

2. Description of the Prior Art

The term "headwall" or "end wall" typically refers to a reinforced concrete structure that supports one end of a pipe, such as a drain pipe, and retains earth fill on one side of the structure. The usual technique for constructing concrete headwalls involves the manual preparation of forms made typically of wood or metal and built at the intended headwall location. The forms are stripped away from the concrete after the headwall is formed. The forms are temporary in nature and require a significant amount of labor expense for carpentry and other trades necessary for the manual erection of these forms. Several trips to the headwall construction site are generally required before the concrete headwall is complete.

This prior art headwall construction method has other numerous disadvantages. For example, the headwall construction site is often located in an inaccessible or undeveloped area. The wooden forms most often used to construct the concrete headwall are typically made of heavy wooden planks and plywood sections that are nailed together and are difficult, in practice, to erect in these areas. The forms must be stabilized with timbers, boards and stakes that are driven into the ground at the construction site. This can be difficult, time consuming and labor-intensive at undeveloped sites. In addition, paper or another similar material must be positioned around the drain pipe, which extends through the forms to prevent concrete seepage and loss when the forms are filled with concrete. There is usually a pronounced gap in the area around the drain pipe because of the paper positioned around the drain pipe while the concrete cures. Furthermore, the forms must be greased to facilitate their removal after the concrete has hardened. Finally, the poured concrete must be vibrated to remove air voids and the surface of the concrete, when hardened, must be smoothed to remove imperfections left by the forms.

Over the years, attempts have been made to improve the "traditional" prior art method of constructing concrete headwalls discussed hereinabove. For example, U.S. Pat. No. 1,098,766 to Scully et al. discloses a bank retainer for a culvert pipe formed of a plurality of sheet metal plates that are bolted together. In operation, a bottom section of the bank retainer is placed below the culvert pipe and an upper section placed above the culvert pipe. The two sections are then bolted together. Once the sheet metal, box-like structure of the bank retainer is formed, the interior of the bank retainer is filled with earth through an opening in the front of the bank retainer. U.S. Pat. No. 1,664,503 to Cornell discloses a bulkhead wall for a culvert pipe that includes a series of metal front plates that surround the culvert pipe.

The front plates have braces that extend outward into the backfill located behind the bulkhead wall. U.S. Pat. No. 3,779,021 to Green discloses a method of forming a concrete headwall that includes the use of prefabricated forms for concrete. The forms are removable after formation of the concrete headwall.

A more recent attempt to improve the traditional method discussed previously is disclosed by U.S. Pat. No. 4,723,871 to Roscoe. The Roscoe patent discloses a shell-like retainer structure for forming headwalls. The shell-like retainer structure includes two spaced apart plates that each define a U-shaped opening. The plates are centered over a drain pipe with the U-shaped opening defined by the respective plates cooperating with the drain pipe. After the plates are centered over the drain pipe, the structure is filled with earth through an opening formed in the top of the structure.

While each of these references attempts to improve upon the traditional method of forming concrete headwalls, several of the devices disclosed by these references are as heavy, bulky, and labor-intensive to use as the concrete forms used in the traditional method. In addition, these devices generally do not provide flexibility in adjusting the height of the headwall. The prior art devices discussed hereinabove typically provide a headwall of a given height that is defined by the height of the device. These devices generally do not provide the ability to alter the height of the headwall in accordance with design parameters for the headwall, such as the terrain at the intended location of the headwall, the amount of backfill that must be retained by the headwall, and the size of the drain pipe that is to be used with the headwall. This is a distinct disadvantage because it is common in the art to design the headwall at the construction site without the benefit of engineering the headwall in advance.

Consequently, it is an object of the present invention to provide a headwall that has an adjustable height that may be quickly and easily altered to suit the particular design criteria at the headwall construction site. It is a further object of the present invention to provide a headwall that overcomes the disadvantages of the traditional method of forming concrete headwalls.

SUMMARY OF THE INVENTION

The above objects are accomplished with a headwall assembly and a method of constructing a headwall in accordance with the present invention. The headwall assembly is intended to support a drain pipe. The headwall assembly, according to one embodiment of the present invention, includes a unitary base member, an annular drain pipe adapter, and a unitary lid member. The base member has two longitudinal walls and two end walls, which define an opening extending through the base member for receiving filler material into the base member. The base member further includes a sleeve extending between and connecting the longitudinal walls. The sleeve defines an aperture extending through the longitudinal walls. The drain pipe adapter is configured to be received in the sleeve and has an inner diameter sized to receive the drain pipe. The lid member is configured to engage a top end of the base member and enclose the top end of the base member.

The sleeve connecting the longitudinal walls of the base member may include a flange extending outward from one of the longitudinal walls. The flange may extend outward circumferentially around the aperture except in the area of a keyway recess defined by the flange. The drain pipe adapter may include a lip member configured to cooperate with the flange for connecting the drain pipe adapter to the base member. The lip member of the drain pipe adapter and the flange extending from the sleeve may be configured to be connected together with mechanical fasteners.

The drain pipe adapter may include a projection formed integrally with the lip member. The projection may be configured to cooperate with the keyway recess for preventing rotational movement of the drain pipe adapter relative to the base member when the drain pipe adapter is inserted into the sleeve. The drain pipe adapter may include a flange extending from the lip member. The flange extending from the lip member may be configured to be connected directly to the drain pipe with mechanical fasteners.

The longitudinal walls of the base member may be connected together by a plurality of cone shaped connectors extending from one of the longitudinal walls to the opposing longitudinal wall. The cone shaped connectors may define cone shaped recesses in the surface of the longitudinal wall. The headwall assembly may further include a plurality of cone shaped plugs configured to engage the recesses defined by the connectors.

The top end of the base member may define a circumferentially extending recess and the lid member may include a depending lip configured to engage the recess such that the lid member snap fits onto the base member.

The base member, the drain pipe adapter, and the lid member may be made of plastic. The lid member may include integrally formed projections for attaching light reflectors to the lid member.

The headwall assembly may further include a unitary wall member configured for attachment to one of the end walls of the base member. The wall member may be formed by two longitudinal walls and two end walls that define an opening extending through the wall member for receiving filler material into the wall member. At least one of the end walls of the wall member and at least one of the end walls of the base member are preferably configured to connect together with a tongue-in-groove connection. A second lid member may be provided to be positioned on top of and engage a top end of the wall member to enclose the opening extending through the wall member. The second lid member may be used to replace the lid member configured to engage the top end of the base member, with the second lid member formed to engage the top end of the base member and the top end of the wall member to enclose the respective openings defined through the base member and the wall member.

The headwall assembly may include a pair of wall members each configured to connect to one of the end walls of the base member. The end walls of the wall members may be configured to connect to the end walls of the base member with tongue-in-groove connections. The wall members may also be made of plastic.

The headwall assembly of the present invention may further include a sectional member provided between the base member and the lid member. The sectional member is configured to engage the top end of the base member. The lid member, in this embodiment of the present invention, is configured to engage a top end of the sectional member to enclose the top end of the sectional member. The sectional member is defined by two longitudinal walls and two end walls. The longitudinal walls and end walls define an opening extending through the sectional member that cooperates with the opening extending through the base member for receiving filler material into the headwall assembly. The sectional member may be made of plastic.

The top end of the base member may define a circumferentially extending recess and the sectional member may include a depending lip configured to engage the recess defined in the base member such that the sectional member snap fits onto the base member. The top end of the sectional member may also define a circumferentially extending recess and the lid member may include a depending lip configured to engage the recess defined in the sectional member such that the lid member snap fits onto the sectional member.

The unitary wall member, discussed previously, may be configured for attachment to a common end wall of the headwall assembly formed by the end walls of the base member and sectional member when the sectional member is placed on top and in engagement with the base member. At least one of the end walls of the wall member and at least one of the common end walls of the headwall assembly are preferably configured to connect together with a tongue-in-groove connection.

The present invention is also a method of constructing a headwall, including the steps of: providing a headwall assembly comprised of a base member and a lid member, with the base member having a ground engaging edge for engaging the ground; positioning the base member in engagement with the ground along the ground engaging edge of the base member, with the base member having two longitudinal walls and two end walls defining an opening extending through the base member, and with the base member having a sleeve extending between and connecting the longitudinal walls, with the sleeve defining an aperture extending through the longitudinal walls; extending a drain pipe through the aperture defined by the sleeve; filling the opening in the base member with filler material; and positioning the lid member on the base member such that the headwall is formed and a top end of the base member is enclosed.

The headwall assembly may further include the sectional member, discussed previously, which is configured to engage the top end of the base member. The method may further include the steps of: placing the sectional member in engagement with the top end of the base member, with the sectional member including two longitudinal walls and two end walls defining an opening extending through the sectional member and cooperating with the opening defined by the base member; and positioning the lid member on top of the sectional member such that the headwall is formed and a top end of the sectional member is enclosed.

The headwall assembly may further include the drain pipe adapter discussed previously, which is configured to be received in the sleeve connecting the longitudinal walls of the base member. When the drain pipe adapter is used with the headwall assembly, the method may include the steps of: inserting the drain pipe adapter into the sleeve; and extending a drain pipe through the drain pipe adapter.

As set forth previously, the sleeve connecting the longitudinal walls of the base member may include the flange extending outward from one of the longitudinal walls of the base member. The flange extends circumferentially around the aperture defined by the sleeve except in the area of the keyway recess defined by the flange. The lip member of the drain pipe adapter is preferably configured to cooperate with the flange, with the lip member having the integrally formed projection configured to cooperate with the keyway recess. The method may further include the step of inserting the drain pipe adapter into the sleeve such that the lip member cooperates with the flange and the projection is received in the keyway recess thereby preventing rotational movement of the drain pipe adapter relative to the base member.

The present invention is further directed to a wall member for use in constructing earth retaining walls and like structures. The wall member is comprised of a rectangular shaped unitary shell member defined by two longitudinal walls and two end walls. The longitudinal walls and end walls define an opening extending through the shell member for receiving filler material into the shell member. The end walls of the shell member are configured to connect to the end walls of additional wall members to form the earth retaining wall.

The shell member may include internal partitions defining a plurality of chambers within the shell member for receiving filler material. The end walls of the shell member may be configured to connect to the end walls of the additional wall members through a tongue-in-groove connection. At least one of the longitudinal walls of the shell member may be configured to connect to the end wall of one of the additional wall members. The shell member may be made of plastic.

Further details and advantages of the present invention will become apparent from the following detailed description read in conjunction with the drawings, wherein like parts are designated with primed reference numerals throughout.

DETAILED DESCRIPTION OF THE PREFERRED EMBODIMENTS

Figure 1:
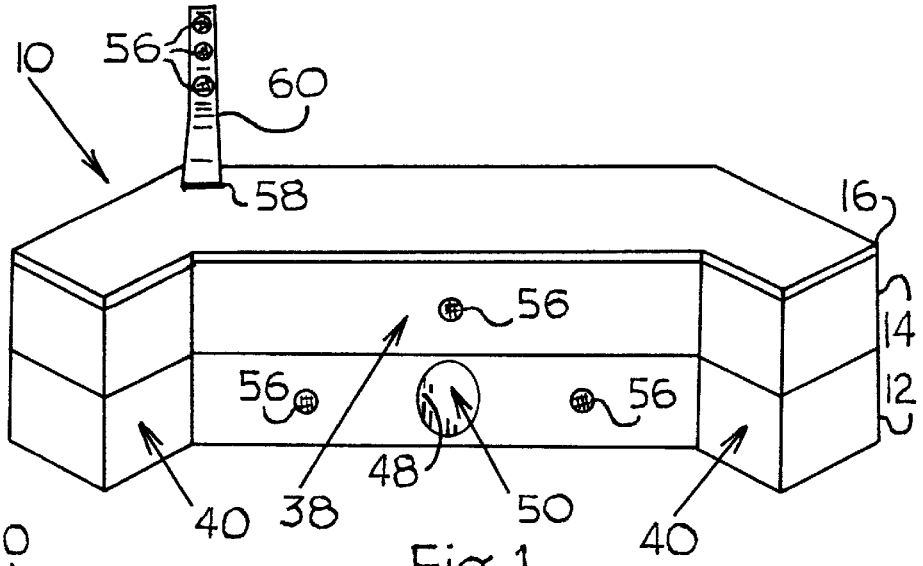
FIG. 1 is a perspective view of a headwall for a drain pipe in accordance with the present invention.
Figure 2:
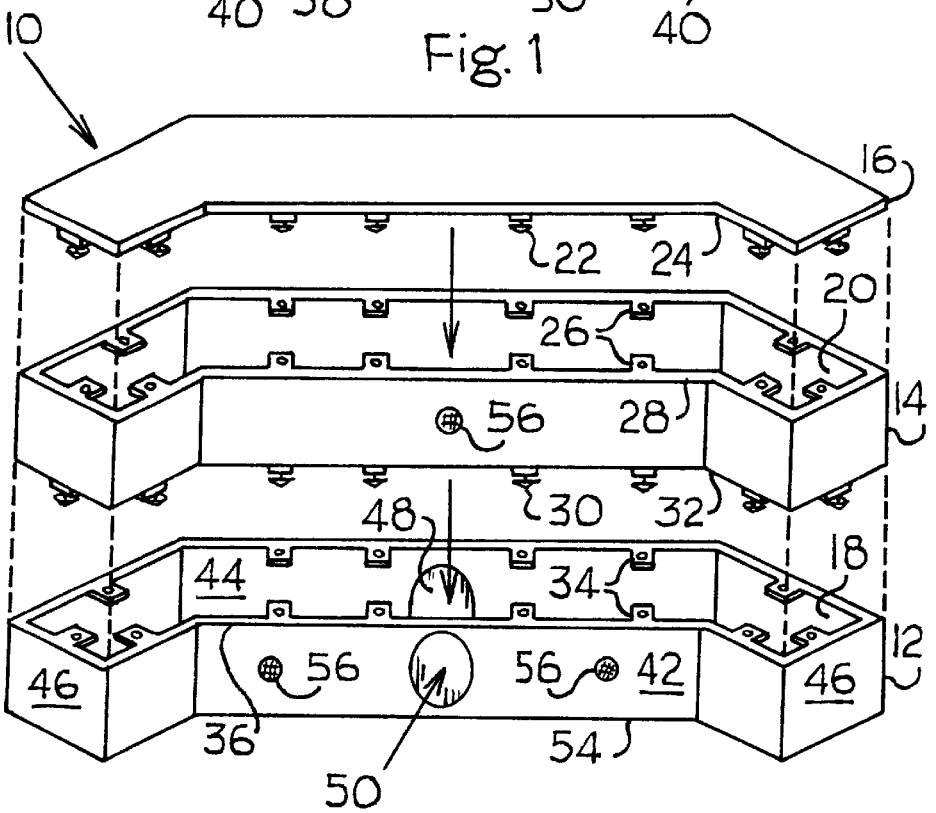
FIG. 2 is an exploded, perspective view of the headwall of FIG. 1.

FIGS. 1 and 2 generally show a headwall or end wall 10 made in accordance with the present invention. The headwall 10 generally includes a unitary base member 12, at least one unitary sectional member 14 positioned on top of the base member 12 and a unitary lid member 16 positioned on top of the sectional member 14. The base member 12 and the sectional member 14 are formed as hollow shell structures each defining an opening extending therethrough and designated with reference numbers 18, 20, respectively. The base member 12, the sectional member 14 and the lid member 16 are preferably made of plastic such as polypropylene, polyethylene, polyvinyl chloride and polyurethane. Consequently, the base member 12, the sectional member 14 and the lid member 16 are relatively light in weight and can be easily manipulated by one person.

The lid member 16 is connected securely to the sectional member 14 located below the lid member 16. Similarly, the sectional member 14 is connected securely to the base member 12 located below the sectional member 14. In the preferred embodiment, the lid member 16 includes a plurality of male connecting members 22 formed along a bottom edge or end 24 of the lid member 16. The male connecting members 22 depending from the lid member 16 are configured to cooperate with a plurality of female connecting members 26 formed along a top edge or end 28 of the sectional member 14. The sectional member 14 further includes a plurality of male connecting members 30 formed along a bottom edge or end 32 of the sectional member 14. The male connecting members 30 depending from the sectional member 14 are configured to cooperate with a plurality of female connecting members 34 formed along a top edge or end 36 of the base member 12.

The male connecting members 22, 30 are preferably formed as arrow-shaped projections having barbs which retain the male connecting members 22, 30 in engagement with the respective female connecting members 26, 34 after the male connecting members 22, 30 are placed in engagement with the female connecting members 26, 34. The male-female connecting member "snap fit" arrangement discussed hereinabove is merely illustrative of one type of connection for securing the lid member 16 to the sectional member 14 and for securing the sectional member 14 to the base member 12 to form the headwall 10. Other fastening schemes such as a simple "friction fit" arrangement are envisioned by the present invention. Alternatively, the lid member 16 may be secured to the sectional member 14 and the sectional member 14 secured to the base member 12 with simple straps or brackets (not shown). The straps or brackets may be positioned internally within the headwall 10 or positioned externally on the outer surface of the headwall 10 and extend between the various members comprising the headwall 10.

Figure 5:
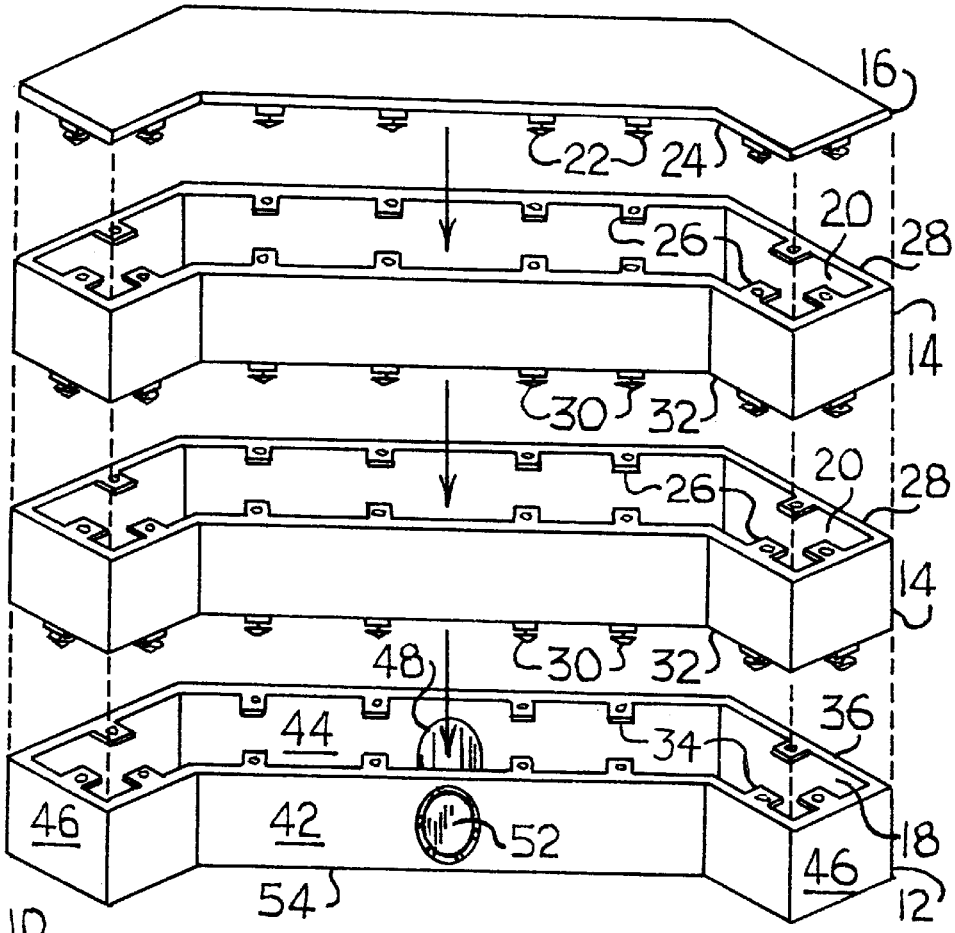
FIG. 5 is an exploded, perspective view of the headwall of FIG. 1 showing the headwall with a plurality of sectional members.

While only one sectional member 14 is shown with the headwall 10 in FIGS. 1 and 2, it will be apparent that the headwall 10 may include a plurality of stacked sectional members 14 as shown in FIG. 5 discussed hereinafter. In addition, the headwall 10 shown in the figures is generally comprised of a rectangular center section 38 with two angled portions 40 at the ends of the rectangular section 38. However, it will be apparent to those skilled in the art that the headwall 10 may have any shape customary in the art, such as square, rectangular or semi-circular, with the base member 12, the sectional member 14, and the lid member 16 each formed to the intended shape of the headwall 10.

Referring now to FIGS. 1–5, the base member 12 is generally defined by two longitudinally extending walls 42, 44 and two end walls 46. A sleeve 48 extends between the longitudinal walls 42, 44. The sleeve 48 is located in the opening 18 defined by the base member 12. The sleeve 48 defines an aperture 50 extending through the longitudinal walls 42, 44 for receiving a drain pipe (not shown). The drain pipe will extend through the sleeve 48 and project outward from the longitudinal walls 42, 44 of the base member 12. The aperture 50 defined by the sleeve 48 may be covered at each of the longitudinal walls 42, 44 by a frangible cover plate 52, as shown in FIG. 5. The respective cover plates 52 are formed integrally as part of the base member 12 and are intended to be broken out and removed before the drain pipe is extended through the aperture 50 defined by the sleeve 48. As an alternative to the cover plate 52 arrangement shown in FIG. 5, the longitudinal walls 42, 44 of the base member 12 may be formed to cover the aperture 50 and be made thinner at the intended location for the aperture 50. The drain pipe may then be used to puncture the longitudinal walls 42, 44 of the base member 12 so that the aperture 50 is formed through the longitudinal walls 42, 44.

The base member 12 further includes a ground engaging or bottom edge 54 for engaging the ground. The base member 12 and the sectional member 14 shown in FIGS. 1–4 will each typically be 1–2 feet high, although they could be higher depending on pipe size and other factors. As shown in FIG. 5, multiple sectional members 14 may be added on top of the base member 12 allowing the height of the headwall 10 to be adjusted to suit the particular headwall construction requirements at hand. In particular, the sectional members 14 will be stacked one on top of the other between the lid member 16 and the base member 12. Each of the sectional members 14 shown in FIG. 5 will typically be 1–2 feet high.

Figure 3:
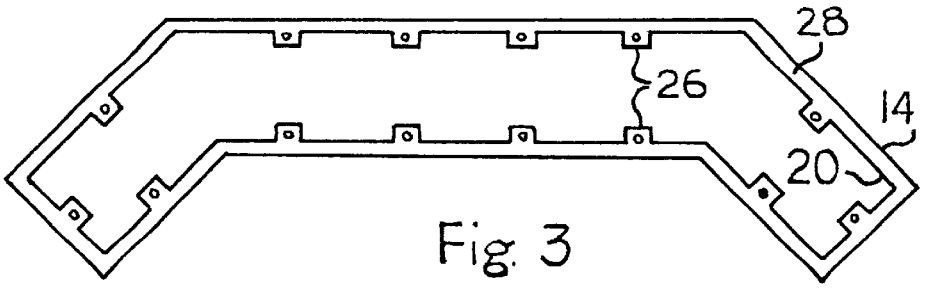
FIG. 3 is a top plan view of a sectional member of the headwall of FIG. 1.
Figure 4:
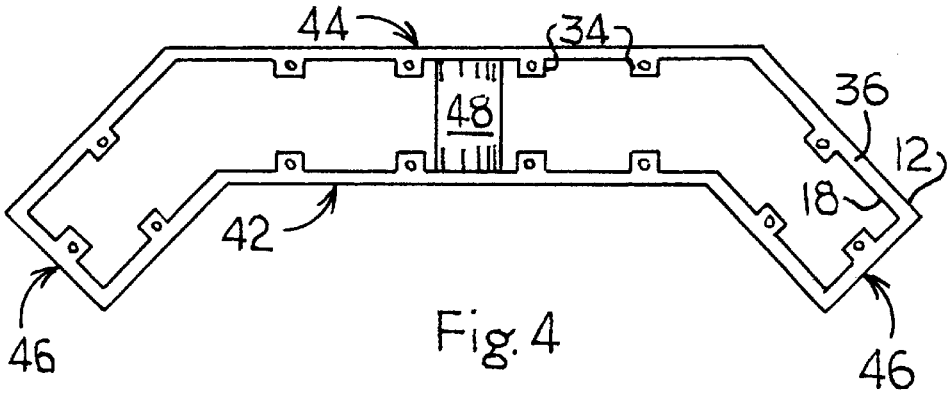
FIG. 4 is a top plan view of a base member of the headwall of FIG. 1.

Referring in particular to FIGS. 3 and 4, the openings 18, 20 defined, respectively, by the base member 12 and the sectional member 14, extend through the base member 12 and the sectional member 14. In addition, the female connecting members 26, 34 connected to the sectional member 14 and the base member 12, respectively, are shown in greater detail in FIGS. 3 and 4.

Referring again to FIGS. 1–5, the headwall 10 may include light reflectors 56 attached to the base member 12, the sectional member 14, and the lid member 16 to improve the visibility of the headwall 10 for safety, especially at night. The light reflectors 56 may be provided as reflective plastic discs or reflective strips adhered to the surface of the base member 12, the sectional member 14, and the lid member 16. The present invention also envisions that the base member 12, the sectional member 14, and the lid member 16 may be made of plastic which has light absorbing and emitting properties for enhanced visibility, especially at night. Furthermore, the lid member 16 may be formed with a recess 58 configured to receive a light reflective delineator bar 60. The delineator bar 60 has one end positioned and supported in the recess 58 and may include light reflectors 56 attached thereto. The delineator bar 60 extends upward from the headwall 10 and may serve as a marker to identify the headwall 10. Characteristic information about the headwall 10 may be imprinted on the delineator bar 60.

Figure 6:
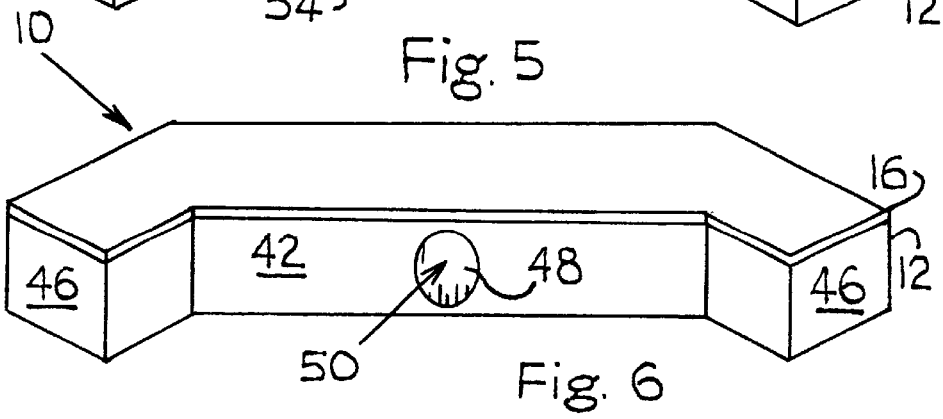
FIG. 6 is a perspective view of the headwall of FIG. 1 showing a lid member attached directly to the base member of the headwall.

FIG. 6 illustrates an embodiment of the headwall 10 in which the sectional member 14 is omitted entirely and the lid member 16 connects directly to the base member 12. In this embodiment of the headwall 10, the male connecting members 22 depending from the lid member 16 cooperate directly with the female connecting members 34 formed along the top edge 36 of the base member 12. The male connecting members 22 and the female connecting members 34 are shown in FIG. 2. The embodiment of the headwall 10 shown in FIG. 6 is suitable for low lying areas where only minimal backfill is necessary or where a taller headwall 10 would be impractical or unnecessary.

Figure 7:
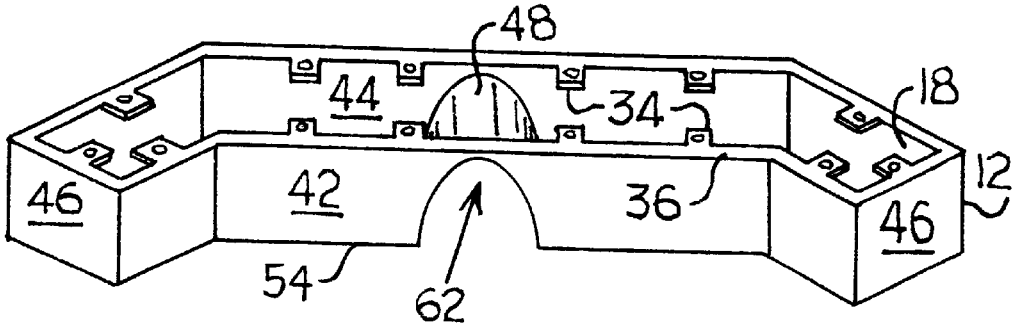
FIG. 7 is a perspective view of an alternative embodiment of the base member of the headwall of FIG. 1.

An alternative embodiment of the base member 12 is shown in FIG. 7. The alternative embodiment of the base member 12 locates the sleeve 48 along the ground engaging edge 54 of the base member 12 such that the sleeve 48 defines a semi-circular or U-shaped sleeve opening 62 along the ground engaging edge 54. The sleeve opening 62 is configured to cooperate with a drain pipe (not shown). The base member 12 shown in FIG. 7 is similar in all other aspects to the base member 12 discussed hereinabove except for the location and formation of the sleeve 48.

Figure 8:
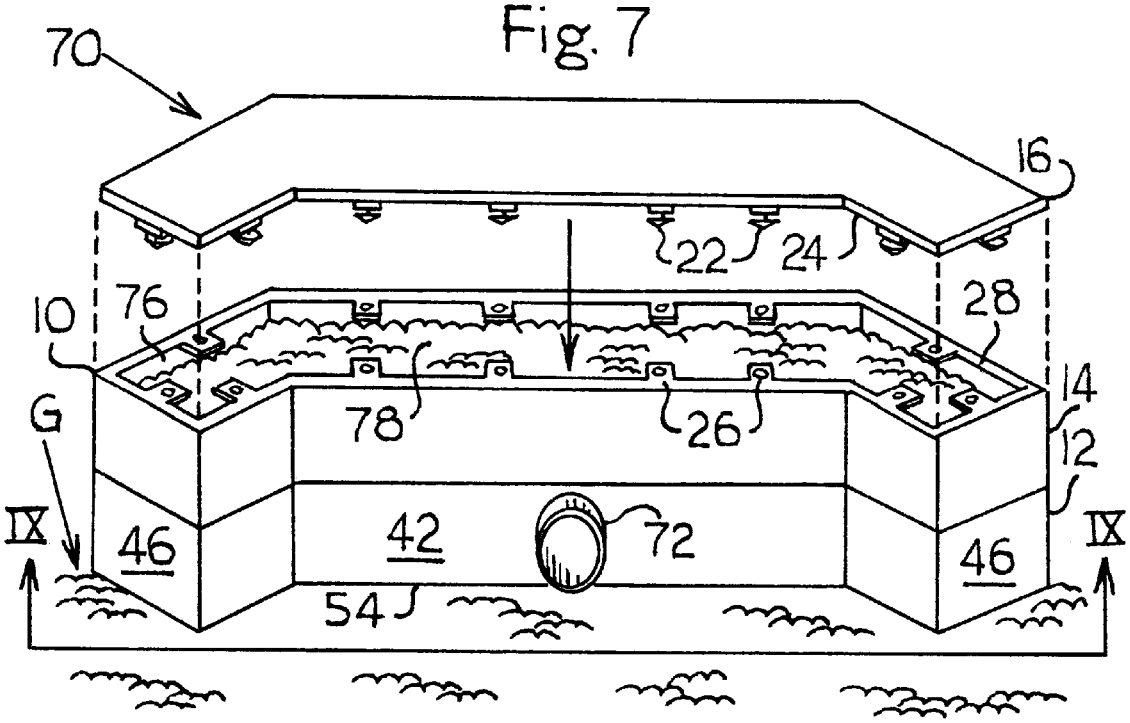
FIG. 8 is a partially exploded, perspective view of the headwall of FIG. 1 showing aggregate positioned within the headwall.
Figure 9:
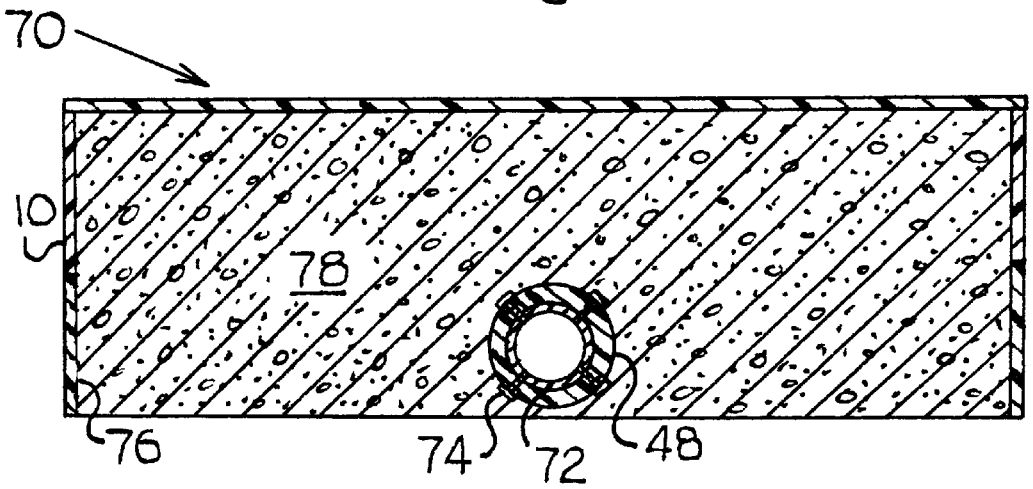
FIG. 9 is an assembled cross-sectional view of the headwall taken along lines IX—IX in FIG. 8.
Figure 11:
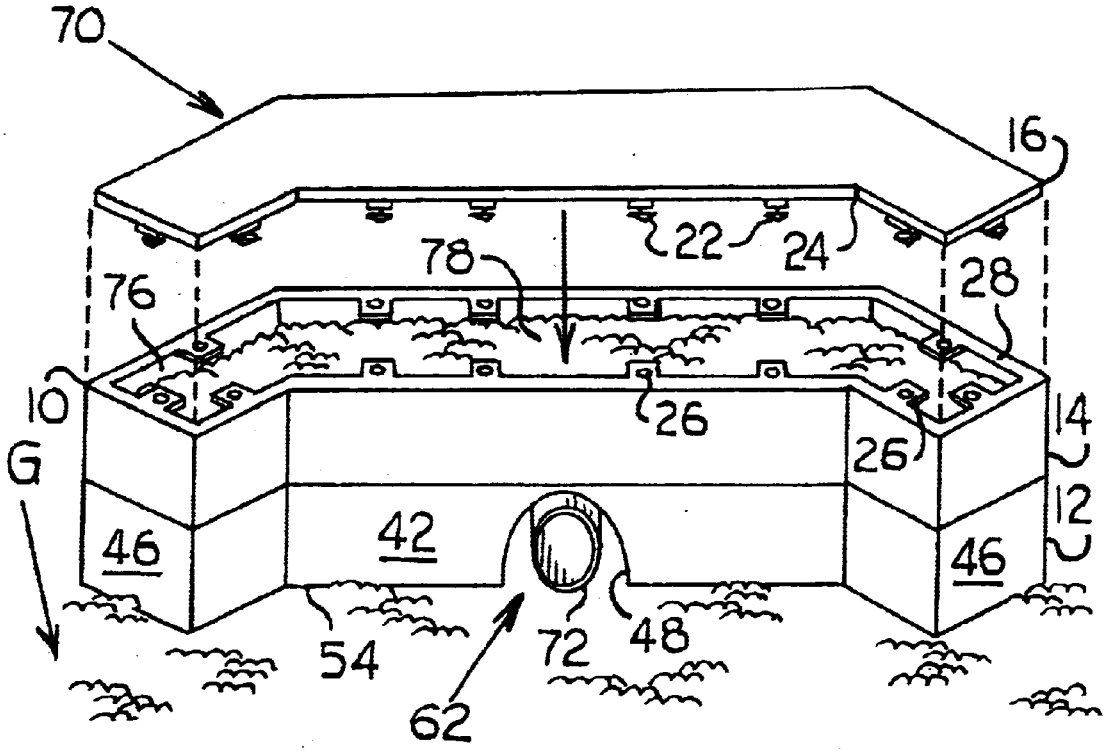
FIG. 11 is a partially exploded, perspective view of the headwall of FIG. 1 showing the headwall with the alternative embodiment of the base member shown in FIG. 7.

Referring to FIGS. 8–11, the present invention is also a sectional headwall or end wall system 70 for a drain pipe 72. The system 70 generally includes the headwall 10 discussed previously having the base member 12, the at least one sectional member 14, the lid member 16, and further includes the drain pipe 72. In use, the base member 12 of the headwall 10 is in contact with the ground along the ground engaging edge 54 of the base member 12. The ground is designated with reference character G in FIGS. 8, 10, and 11. The sectional member 14 is positioned on and engaged securely with the base member 12. The lid member 16 is positioned on and engaged securely with the sectional member 14. The drain pipe 72 extends through aperture 50 defined by the sleeve 48. The drain pipe 72, as shown in FIG. 9, is preferably secured to the sleeve 48 with mechanical fasteners 74, such as metal or plastic nuts, bolts, or screws. In use, the headwall 10 of the system 70 generally defines an internal space 76 bounded by the ground G, the base member 12, and the sectional member 14. The sectional end wall system 70 generally further includes filler material 78 positioned within the internal space 76 defined by the headwall 10. Suitable materials for the filler material 78 include earth, sand, aggregate, concrete and other materials customary in the art. The internal space 76 is preferably entirely filled with the filler material 78 as shown in FIGS. 8, 9, and 11.

Figure 10:
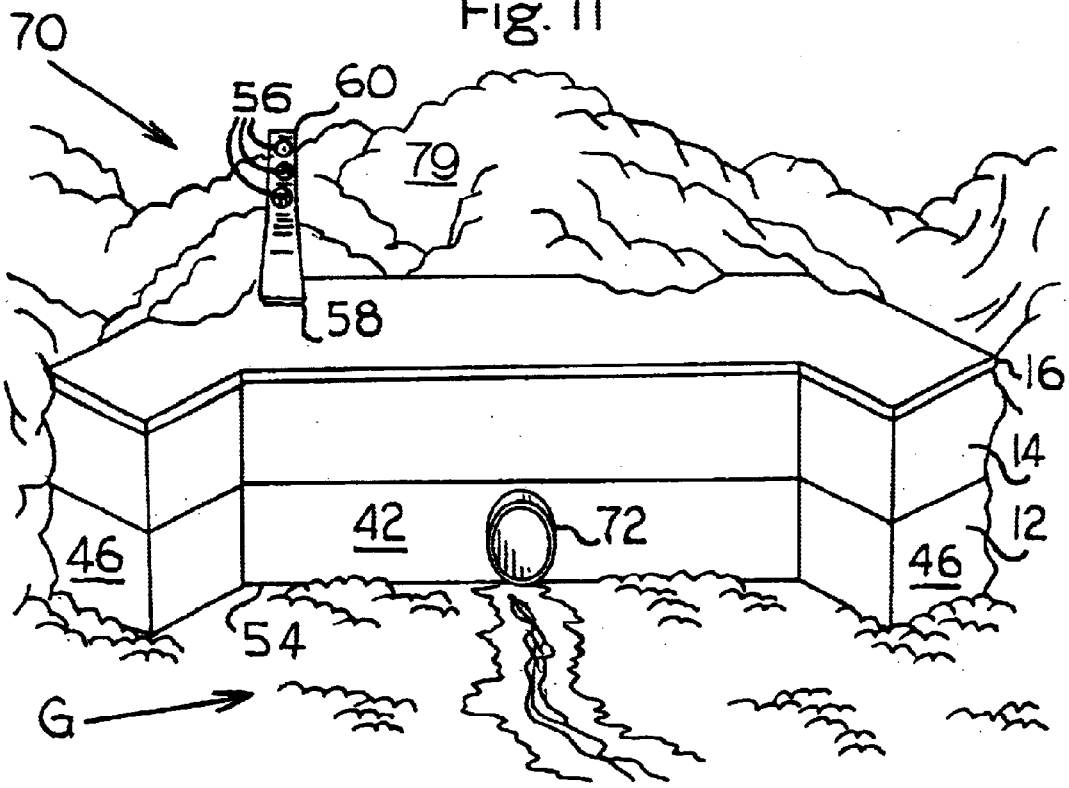
FIG. 10 is a perspective view of the headwall of FIG. 1 showing the headwall retaining backfill.

With reference to FIGS. 1–10, the sectional headwall or end wall system 70 is constructed as discussed hereinafter. The base member 12 is positioned at the intended headwall construction site with the ground engaging edge 54 of the base member 12 positioned against the ground G. The drain pipe 72 is then extended through the aperture 50 defined by the sleeve 48. At least one sectional member 14 is positioned on top of the base member 12 and engaged securely with the underlying base member 12. If additional sectional members 14 are required, they are stacked upon the underlying sectional member 14. The internal space 76 defined by the ground G, the base member 12, and the at least one sectional member 14 is then filled with the filler material 78, such as aggregate. The sleeve 48 advantageously protects the drain pipe 72 from damage as the headwall 10 is filled with the filler material 78. Prior to filling the internal space 76 defined by the headwall 10 with the filler material 78, the drain pipe 72 may be affixed to the sleeve 48 of the base member 12 with fasteners 74. The fixed connection between the drain pipe 72 and the sleeve 48 provided by the fasteners 74 enhances the stability of the headwall 10 as will be appreciated by those skilled in the art. The lid member 16 is then placed on top of and engaged securely with the sectional member 14 thereby completing the headwall 10 and enclosing the internal space 76. The area behind the headwall 10 may then be backfilled with earth, rock, or other fill material 79 as shown in FIG. 10. The headwall 10 serves to support the drain pipe 72 and retain the earth fill 80 located behind the headwall 10. The system 70 shown in FIG. 11 incorporates the alternative embodiment of the base member 12 shown in FIG. 7 and is constructed in a similar manner to the process described hereinabove.

The lightweight sectional headwall 10 and a sectional headwall system 70 described hereinabove overcomes the disadvantages discussed previously in connection with the traditional method of forming concrete headwalls. The sectional headwall 10 of the present invention provides an adjustable height headwall that quickly and easily forms a headwall without the use of heavy and labor-intensive concrete forms, or their equivalents generally known in the prior art. The height of the sectional headwall 10 of the present invention can be quickly adjusted on site by adding or subtracting sectional members 14. The sleeve 48 of the base member 12 of the headwall 10 provides added protection for the drain pipe 72 when the headwall 10 is filled with filler material 78. Furthermore, the addition of light reflectors 56 and/or a delineator bar 60 and the use of light absorbing and emitting plastic enhance the safety aspects of the sectional headwall 10 and the sectional headwall system 70 of the present invention. Finally, the use of a plastic headwall 10 filled with aggregate, sand or earth provides the secondary benefit that the headwall 10 will collapse and absorb energy during an impact with an automobile, further enhancing the safety aspects of the present invention.

Referring to FIGS. 12–21 a second embodiment of the headwall 10', or headwall assembly, made in accordance with the present invention is shown. The headwall 10' includes a unitary base member 12', at least one unitary sectional member 14' positioned on top of the base member 12' and a unitary lid member 16' positioned on top of the sectional member 14' in a similar manner as the headwall 10 discussed previously in connection with FIGS. 1–10. The second embodiment of the headwall 10' shown in FIGS. 12–21 differs from the headwall 10 of FIGS. 1–10 in that the headwall 10' further includes an annular drain pipe adapter 80 configured to cooperate with the base member 12'. The base member 12', sectional member 14', lid member 16', and drain pipe adapter 80 are preferably made of plastic, such as any of those identified previously in connection with the headwall 10'.

Figure 12:
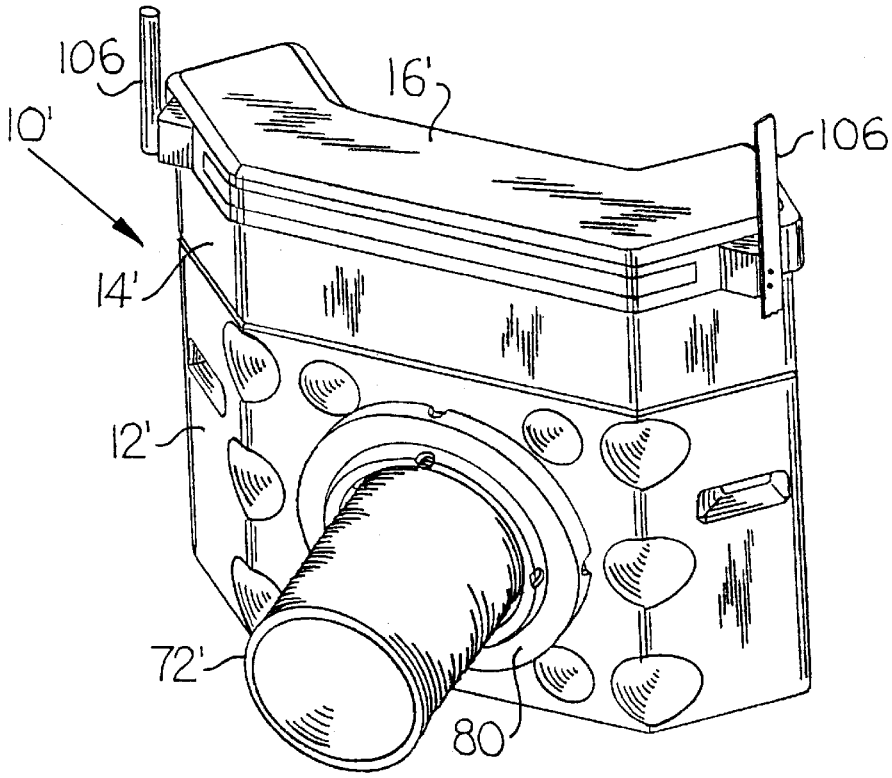
FIG. 12 is a rear perspective view of a second embodiment of the headwall in accordance with the present invention.
Figure 14:
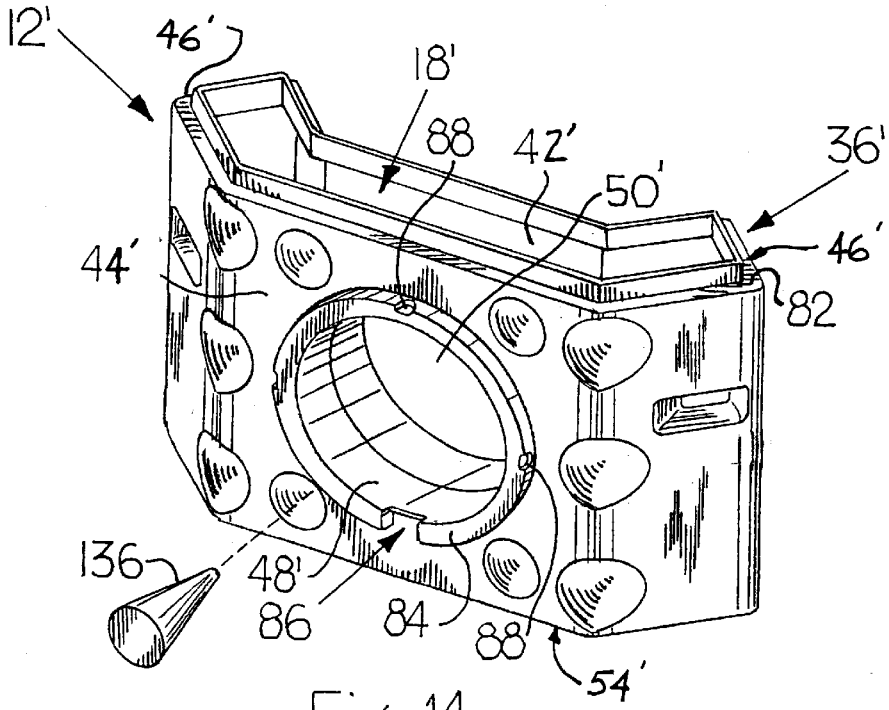
FIG. 14 is a rear perspective view of a base member used in the headwall of FIG. 12.

The base member 12' and the sectional member 14' are formed as hollow shell structures. The base member 12' includes two longitudinal walls 42',44' and two end walls 46' that define an opening 18' extending through the base member 12'. The opening 18' is provided for receiving filler material into the base member 12' when the headwall 10' is assembled at a construction site. The base member 12' further includes a sleeve 48' that extends between and connects the longitudinal walls 42',44'. The sleeve 48' defines an aperture 50' extending through the longitudinal walls 42',44'. The drain pipe adapter 80 fits into the aperture 50' defined by the sleeve 48' as discussed hereinafter. The positioning of the drain pipe adapter 80 into the aperture 50' defined by the sleeve 48' is shown in FIG. 12. A top edge or end 36' of the base member 12' defines a circumferentially extending recess 82 that is used to secure the sectional member 14' onto the base member 12'.

The base member 12' is generally similar in construction to the base member 12 discussed previously in connection with FIGS. 1–10, but now further includes a connection arrangement for connecting the drain pipe adapter 80 to the base member 12'. The sleeve 48' connecting the longitudinal walls 42',44' of the base member 12' of FIGS. 12–21 includes an outward projecting flange 84. The flange 84 extends from only one of the longitudinal walls 42',44', preferably the earth-retaining longitudinal wall 44' of the headwall 10' when the headwall 10' is constructed. The opposing longitudinal wall 42' of the headwall 10' is the outward facing side of the headwall 10' and may include a decorative facade, such as the brick facade shown in FIGS. 29 and 30 discussed hereinafter. The flange 84 may also be located on longitudinal wall 42'. The flange 84 extends outward circumferentially around the aperture 50' defined by the sleeve 48' except in the area of a keyway recess 86 defined by the flange 84. The flange 84 preferably further includes notches 88 located at spaced intervals around the circumference of the flange 84, which are locations at which mechanical fasteners may be inserted to connect the drain pipe adapter 80 to the base member 12', as discussed further hereinafter.

The sectional member 14' is positioned on top of the base member 12' and is generally configured to engage the top end 36' of the base member 12'. The sectional member 14' is optional and the lid member 16' may be configured to engage directly onto the top end 36' of the base member 12', as discussed hereinafter in connection with FIG. 26. The addition of the sectional member 14' (or multiple sectional members 14') allows the height of the headwall 10' to be adjusted as necessary to meet design criteria. Additional sectional members 14' may be provided on the base member 12' as necessary to meet design criteria.

Figure 15:
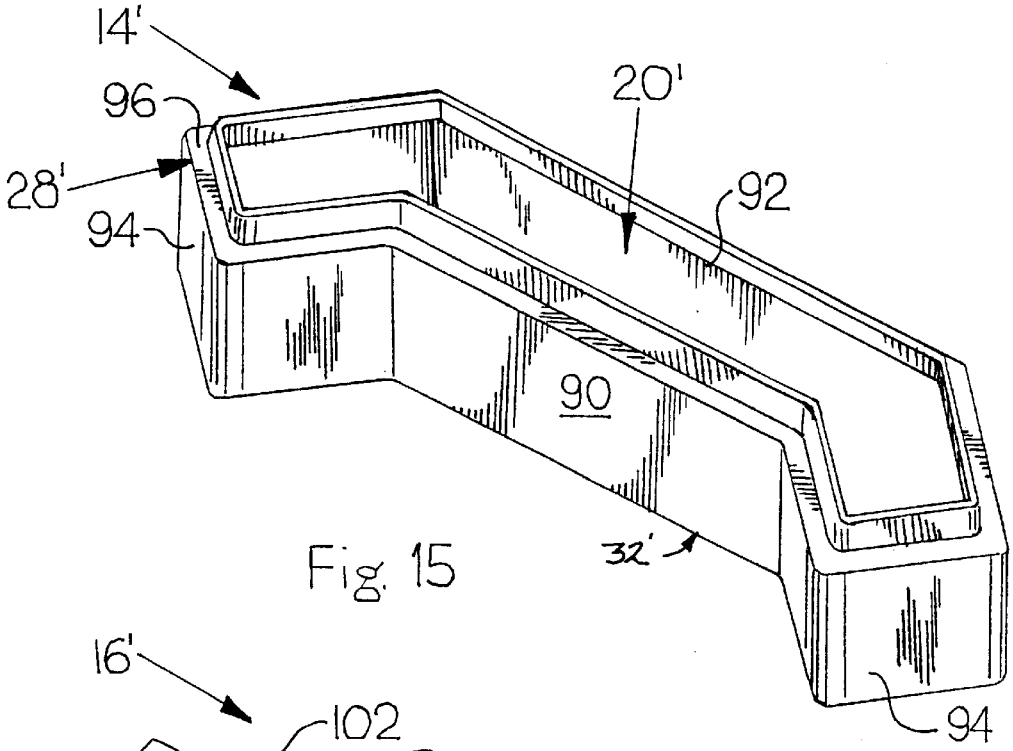
FIG. 15 is a front perspective view of a sectional member used in the headwall of FIG. 12.
Figure 22:
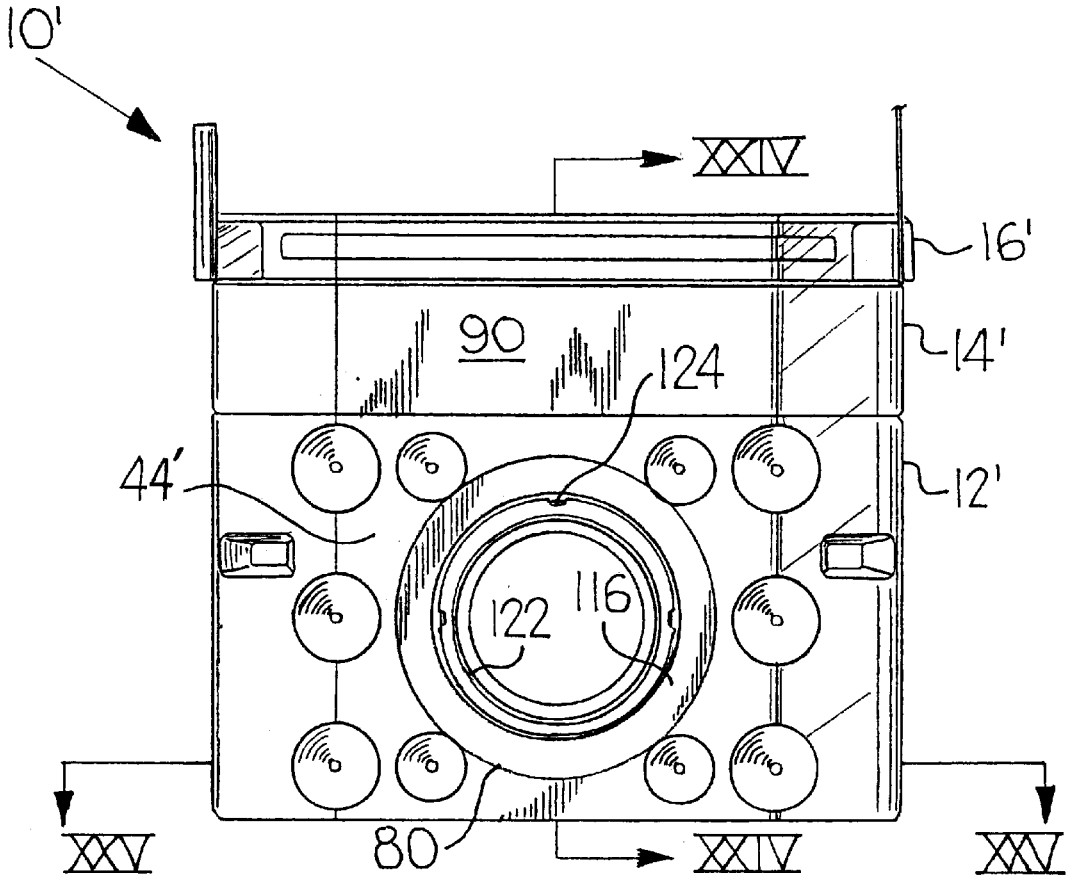
FIG. 22 is a rear view of the headwall of FIG. 12.
Figure 24:
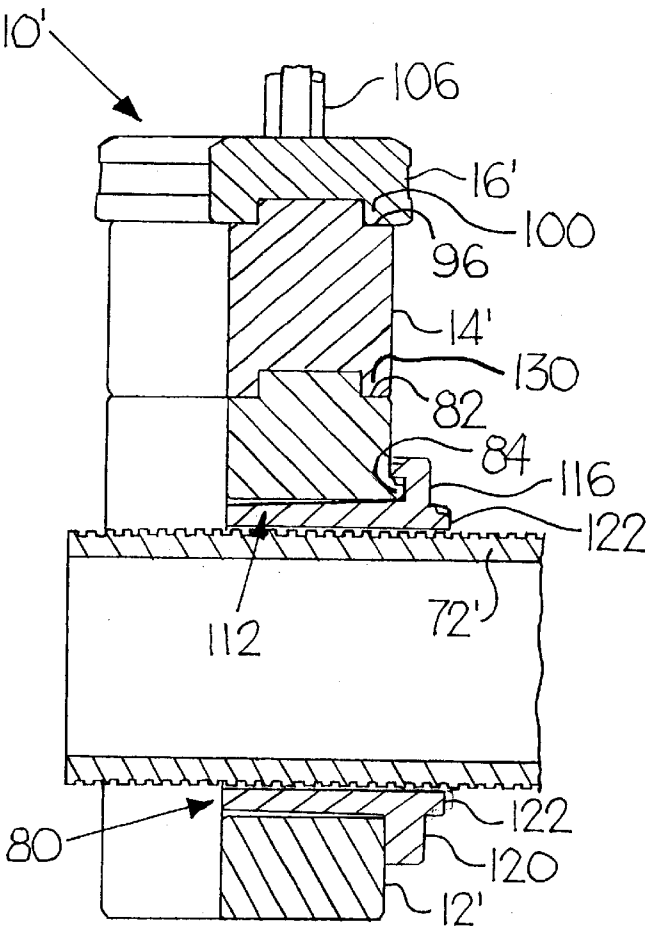
FIG. 24 is a cross-sectional view taken along lines XXIV—XXIV in FIG. 22.
Figure 23:
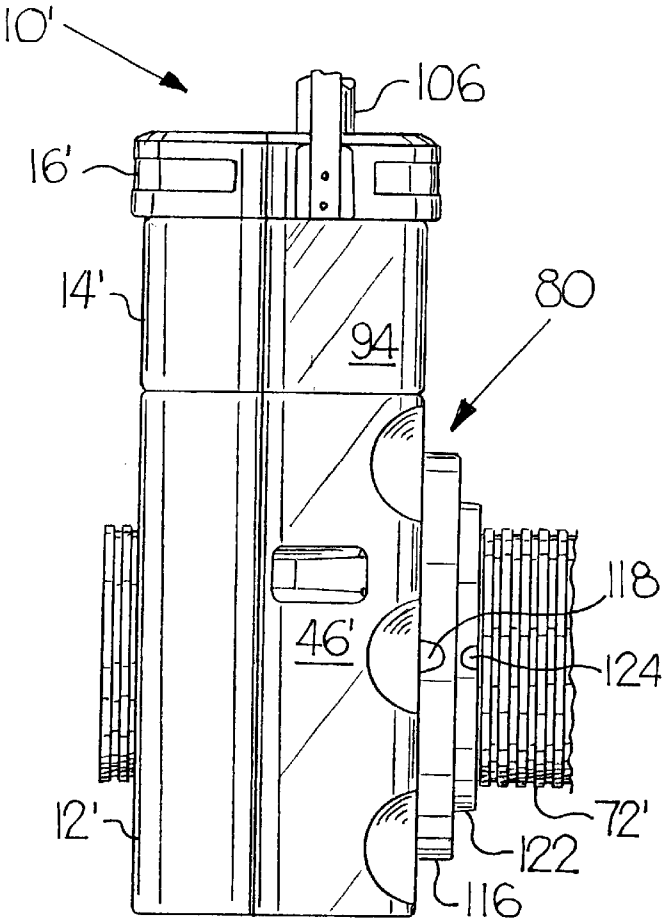
FIG. 23 is a side view of the headwall of FIGS. 12 and 22.

FIG. 15 shows an isolated view of the sectional member 14'. The sectional member 14' includes two longitudinal walls 90,92 and two end walls 94 in a similar manner to the base member 12'. The longitudinal walls 90, 92 and end walls 94 define an opening 20' extending through the sectional member 14'. A top edge or end 28' of the sectional member 14' defines a circumferentially extending recess 96 that is used to secure the lid member 16' onto the sectional member 14'. A bottom edge or end 32' of the sectional member 14' is configured to cooperate with the recess 82 defined at the top end 36' of the base member 12' to secure the sectional member 14' to the base member 12'. The details of the connection between the sectional member 14' and the base member 12' will be discussed herein in connection with FIGS. 22–24.

Figure 16:
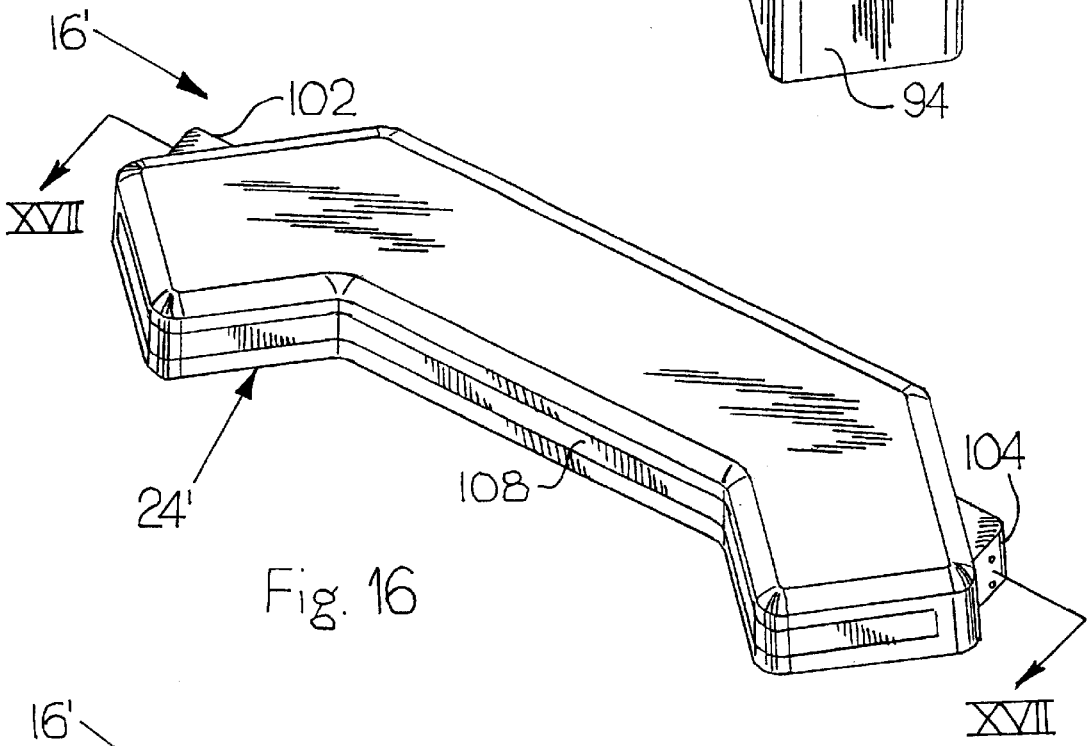
FIG. 16 is a front perspective view of a lid member used in the headwall of FIG. 12.
Figure 17:
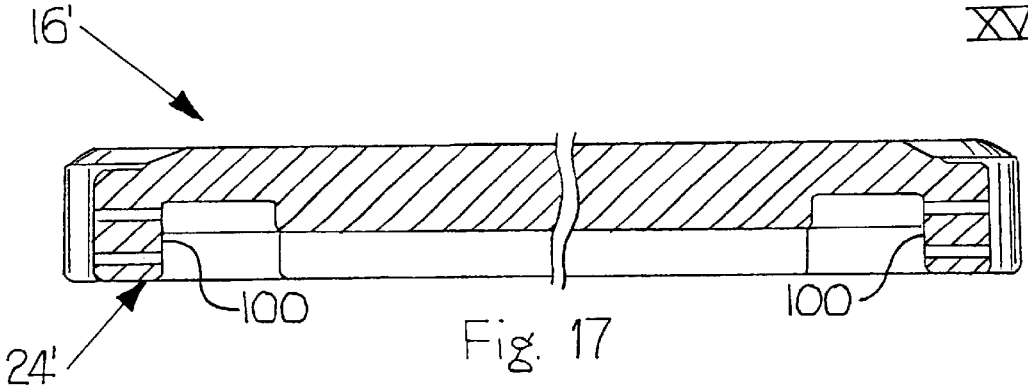
FIG. 17 is a cross-sectional view taken along lines XVII—XVII in FIG. 16.
Figure 18:
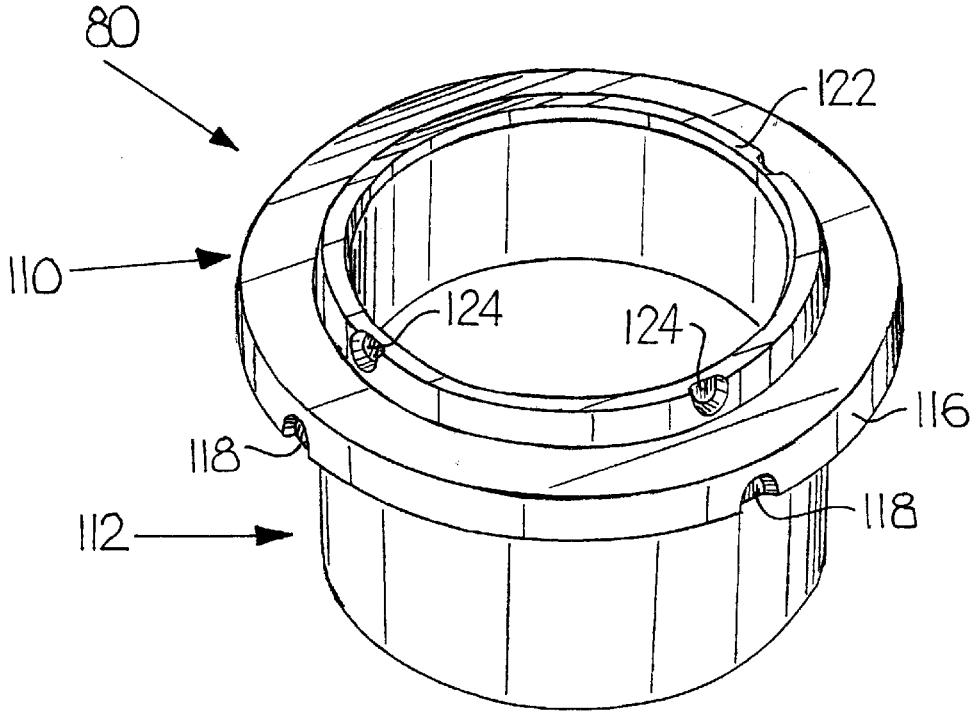
FIG. 18 is a perspective view of a drain pipe adapter used with the headwall of FIG. 12.
Figure 20:
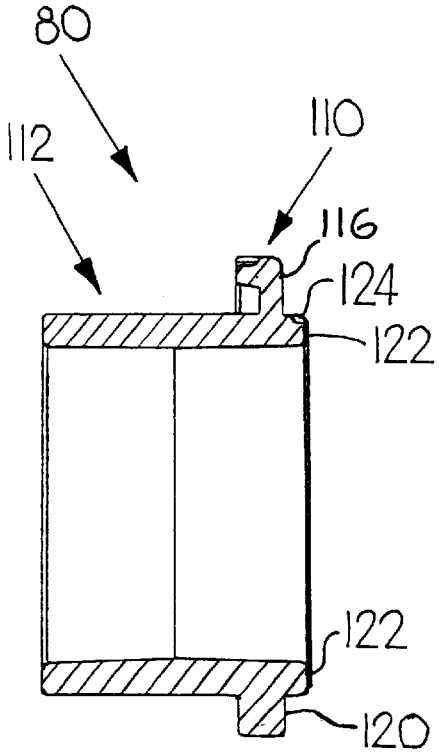
FIG. 20 is a cross-sectional view taken along lines XX—XX in FIG. 19.
Figure 19:
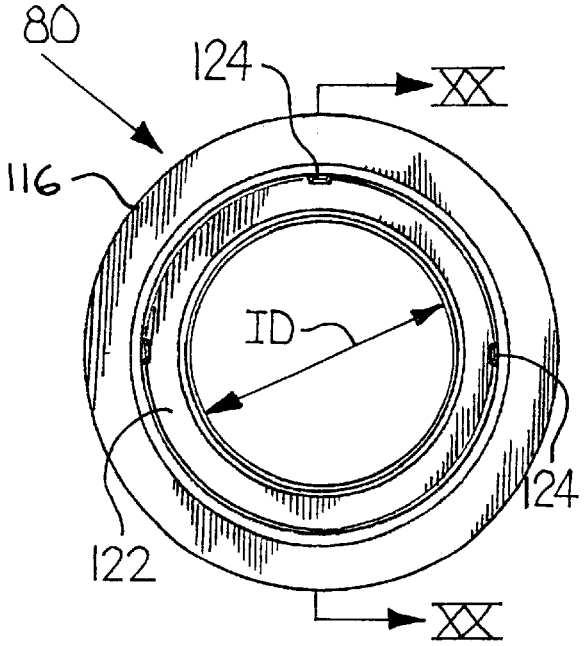
FIG. 19 is a front view of the drain pipe adapter of FIG. 18.
Figure 21:
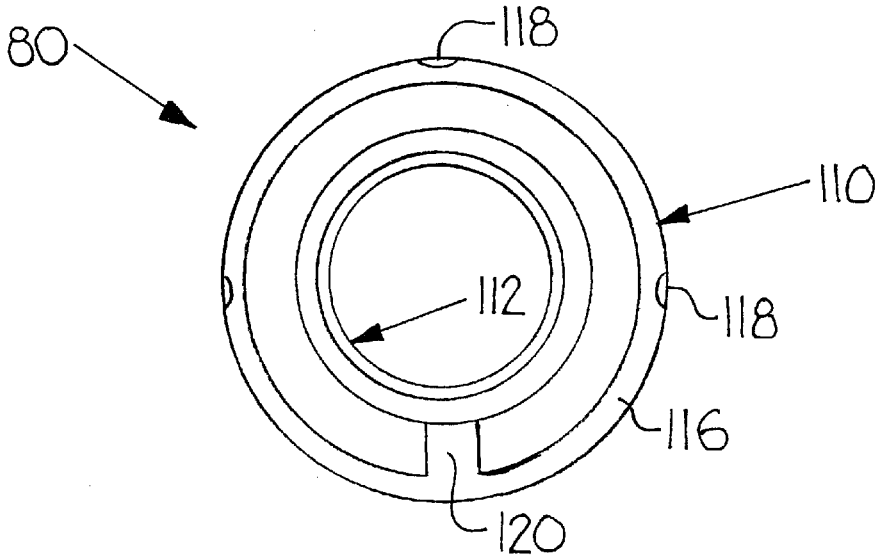
FIG. 21 is a rear view of the drain pipe adapter of FIG. 18.
Figure 26:
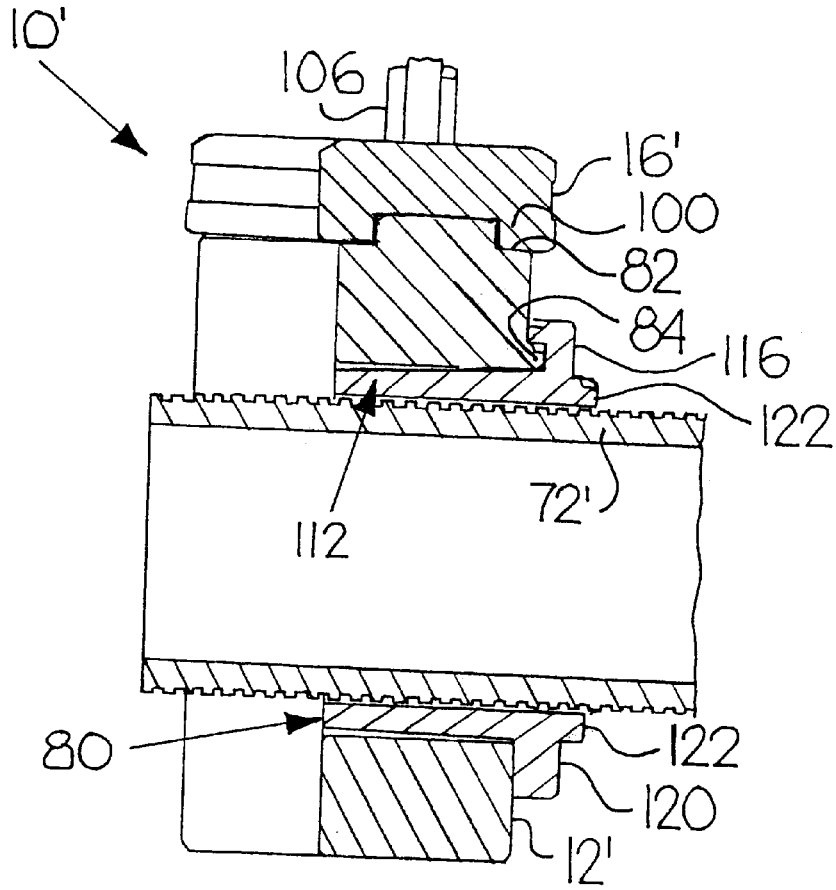
FIG. 26 is a cross-sectional view of the headwall of FIGS. 12 and 22 showing the lid member attached directly to the base member.

Referring to FIGS. 16 and 17, the details of the lid member 16' are shown. The lid member 16' includes a depending lip 100 formed at a bottom edge or end 24' of the lid member 16'. The lip 100 extends around the circumference of the lid member 16', and is configured to engage the recess 96 defined along the top end 28' of the sectional member 14', or the recess 82 defined along the top end 36' of the base member 12' as shown in FIG. 26, discussed hereinafter. The lid member 16' further includes integrally formed projections 102,104. Light reflectors, such as those shown in FIG. 2, may be attached to the projections 102,104 to improve the visibility of the headwall 10', especially at night. The light reflectors may be incorporated into delineator bars 106 (shown in FIG. 12) attached to the projections 102,104. The delineator bars 106 may be attached to the projections 102,104 by simple mechanical fasteners. The projections 102,104 may be located anywhere on the lid member 16'. The lid member 16' may further include a recess 108 extending along one of the surfaces of the lid member 16', preferably an outward facing surface of the lid member 16'. Reflecting tape (not shown) may be adhesively secured in the recess 108 to further improve the visibility of the assembled headwall 10'.

Figure 13:
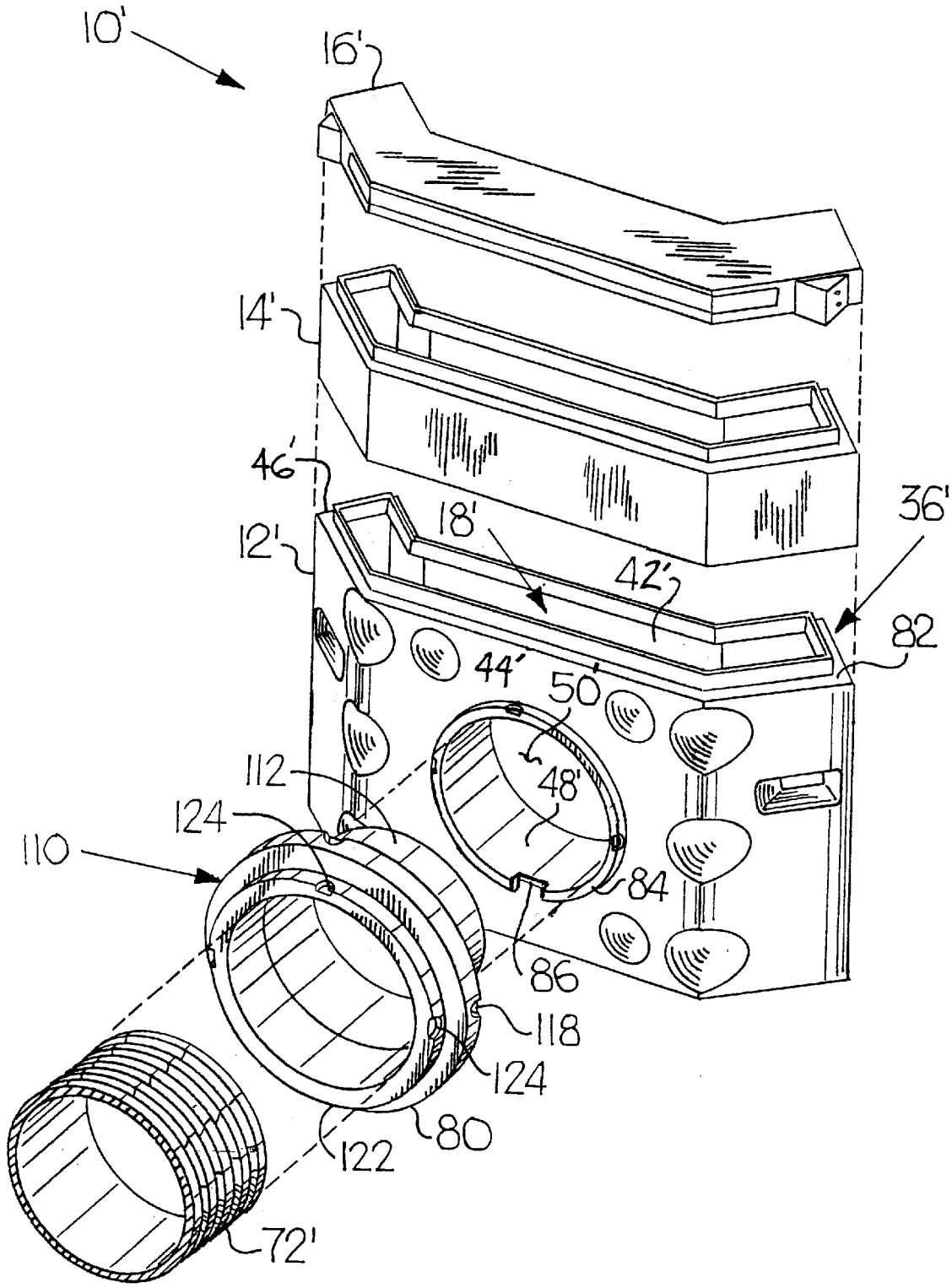
FIG. 13 is an exploded, perspective view of the headwall of FIG. 12.

Referring to FIGS. 18–21, the details of the drain pipe adapter 80 are shown. The drain pipe adapter 80 is annular shaped and defined by a rim portion 110 and a depending sleeve portion 112. The rim portion 110 is configured to cooperate with the flange 84 extending outward from the base member 12' to secure the drain pipe adapter 80 to the base member 12'. The sleeve portion 112 is configured to be received in the aperture 50' defined by the sleeve 48' of the base member 12'. The drain pipe adapter 80 is used to support a drain pipe 72', as shown in FIG. 13.

In the preferred embodiment of the present invention, the base member 12' is provided with an integrally formed sleeve 48'. The drain pipe adapter 80 is provided as an expedient way of adjusting the diameter of the aperture 50' defined by the sleeve 48' to accommodate different sized drain pipes 72' without having to replace the entire base member 12' with a base member 12' having a different sized opening (i.e., smaller apertures 50'). Thus, the drain pipe adapter 80 may be provided in different sizes, with an inner diameter ID of the sleeve portion 112 coming in various sizes to accommodate different sized drain pipes 72'. The outer diameter of the sleeve portion 112 is sized to fit within the sleeve 48' in the base member 12'. As an example of the foregoing, the drain pipe adapter 80 may have a sleeve portion 112 with an inner diameter ID of 18 inches to accommodate 18-inch drain pipes. Alternatively, the drain pipe adapter 80 may be provided with a sleeve portion 112 having a 15-inch inner diameter ID for accommodating 15-inch drain pipes. In each case, the outer diameter of the sleeve portion 112 is sized to be received into the sleeve 48' in the base member 12'.

The drain pipe adapter 80 further includes a lip member 116 configured to cooperate with the flange 84 extending outward from the base member 12'. The lip member 116 cooperates with the flange 84 to seal around the flange 84. The lip member 116 may include notches 118 located at spaced intervals around the circumference of the lip member 116 where mechanical fasteners may be inserted to connect the lip member 116 to the flange 84. The flange 84, as discussed previously, includes notches 88, located at spaced intervals around the circumference of the flange 84. The respective notches 88,118 may be lined up when the drain pipe adapter 80 is inserted into the base member 12', and the drain pipe adapter 80 and base member 12' fixed together with mechanical fasteners.

The lip member 116 further includes an integrally formed projection 120 at one point around the circumference of the lip member 116. The projection 120 is configured to cooperate with the keyway recess 86 defined by the flange 84. In particular, when the drain pipe adapter 80 is inserted into the sleeve 48' in the base member 12', the drain pipe adapter 80 may be rotated to a position where the lip member 116 is received in the keyway recess 86 defined in the flange 84. With the insertion of the projection 120 into the keyway recess 86, the drain pipe adapter 80 is prevented from moving rotationally with respect to the base member 12'. The drain pipe adapter 80 may then be affixed directly to the drain pipe 72'. To secure the drain pipe adapter 80 to the drain pipe 72', the drain pipe adapter 80 includes a flange 122 extending outward from the lip member 116. The flange 122 includes a second series of notches 124 located at spaced intervals around the circumference of the flange 122. Mechanical fasteners (not shown) may be inserted into the notches 121 and through the drain pipe 72' to secure the drain pipe adapter 80 directly to the drain pipe 72'.

Referring now to FIGS. 22–25, further details of the headwall 10' made in accordance with the present invention are shown. The sectional member 14' is positioned on top of the base member 12'. The sectional member 14' includes a depending lip 130 at the bottom end 32' of the sectional member 14', which engages the recess 82 formed at the top end 36' of the base member 12'. Similarly, the lip 100 depending from the lid member 16' engages the recess 96 formed at the top end 28' of the sectional member 14'. The respective connections between the sectional member 14' and base member 12' and between the lid member 16' and the sectional member 14' are preferably snap-fit, friction fit connections. Thus, the lip 130 depending from the bottom end 32' of the sectional member 14' friction fits onto the recess 82 formed at the top end 36' of the base member 12'. A similar connection is made between the lid member 16' and the sectional member 14'.

The sleeve portion 112 of the drain pipe adapter 80 is positioned within the sleeve 48' connecting the longitudinal walls 42', 44' of the base member 12'. The lip member 116 of the drain pipe adapter 80 is positioned over the flange 84 extending from the base member 12'. The projection 120 on the lip member 116 lies within the keyway recess 86 (shown in FIG. 13) defined by the flange 84. The assembled headwall 10' shown in FIGS. 22–24 may be used to retain earth fill as discussed hereinafter in connection with FIGS. 29 and 30.

Figure 25:
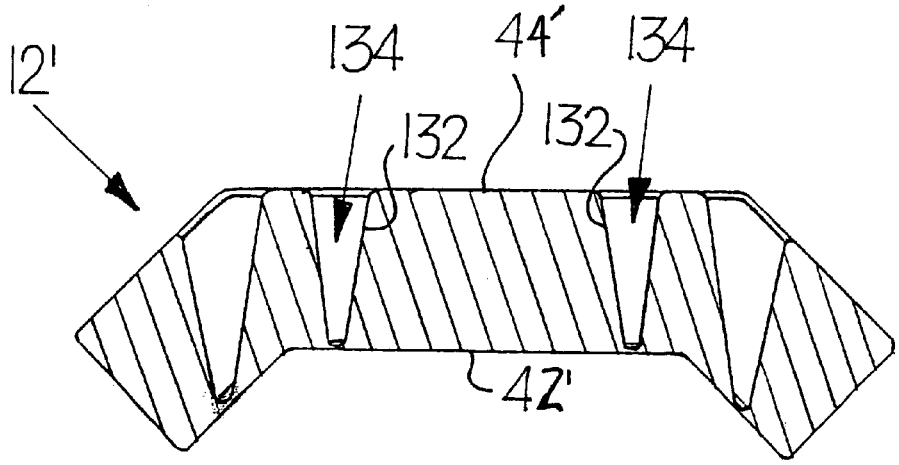
FIG. 25 is a cross-sectional view taken along lines XXV—XXV in FIG. 22.

Referring specifically to FIG. 25, internal features of the base member 12' are shown. FIG. 25 shows a plurality of cone shaped connectors 132 that extend between the longitudinal walls 42',44' of the base member 12'. The connectors 132 are provided to add strength to the base member 12', particularly when the fill material to be received within the base member is a heavy material, such as concrete. The cone shaped connectors 132 are preferably integrally formed with the longitudinal walls 42',44' of the base member 12'. Since the base member 12' is preferably molded from plastic, the cone shaped connectors 132 may be formed when the base member 12' is molded. The cone shaped connectors 132 define cone shaped recesses 134 in the earth-retaining longitudinal wall 44' of the base member 12'. A plurality of cone shaped plugs 136 (shown in FIG. 14) is used to seal the recesses 134 once the headwall 10' is filled with filler material. The cone shaped plugs 136 provide an aesthetic appearance to the base member 12', and the assembly headwall 10'.

As identified previously, the sectional member 14' is optional in the headwall 10' and may be dispensed with entirely. The lid member 16' may affix directly to the base member 12'. This alternative arrangement for the headwall 10' is shown in FIG. 26. In FIG. 26 the lid member 16' engages the top end 36' of the base member 12'. The depending lip 100 of the lid member 16' directly engages the recess 82 formed at the top end 36' of the base member 12'. The connection between the lid member 16' and base member 12' is again preferably a snap fit, friction fit connection. The connection between the drain pipe adapter 80 and the base member 12' is the same as discussed previously in connection with FIGS. 22–24

Figure 27:
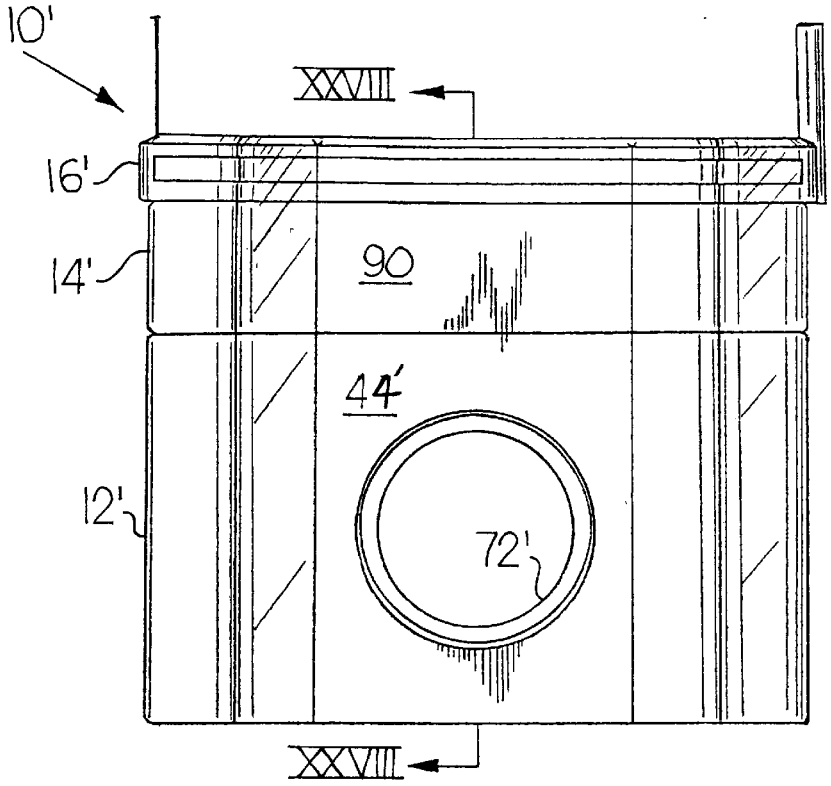
FIG. 27 is a rear view of an embodiment of the headwall of FIG. 12 that does not utilize the drain pipe adapter.
Figure 28:
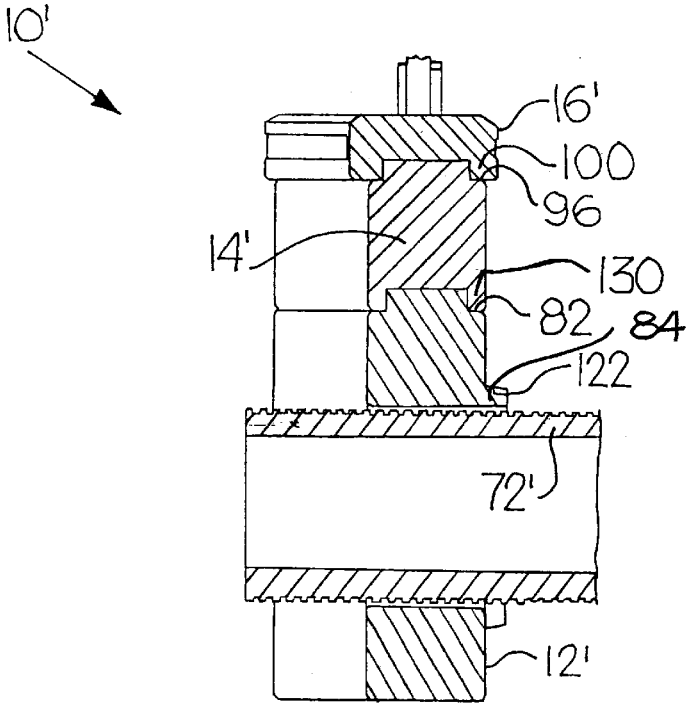
FIG. 28 is a cross-sectional view taken along lines XXVIII—XXVIII in FIG. 27.

Referring to FIGS. 27 and 28, the present invention further envisions that the drain pipe 72' may cooperate directly with the base member 12'. In FIGS. 27 and 28 the drain pipe adapter 80 has been eliminated entirely and the drain pipe 72' cooperates directly with the sleeve 48' connecting the longitudinal walls 42',44' of the base member 12'. Mechanical fastners may be used to fixedly connect the drain pipe 72' and base member 12' together. The fasteners may be inserted through the notches formed in the flange 84 extending outward from the base member. The notches 88 are shown in detail in FIG. 13 discussed previously. The connections between the base member 12' and sectional member 14', and the lid member 16' are the same as discussed previously in connection with FIGS. 22–24.

With the various elements of the headwall 10' now described, construction of the headwall 10' at a construction site in accordance with the present invention will now be discussed with reference to FIGS. 12–24, 29 and 30. The headwall 10' is constructed by providing the base member 12', the lid member 16', and the drain pipe adapter 80 at the intended construction site. Depending on the size of the headwall 10' to be erected, one or more of the sectional members 14' may also be necessary. The base member 12' is then placed in engagement with the ground with a bottom end 54' of the base member 12' contacting the ground. One or more of the sectional members 14' are placed on top of the base member 12', if necessary. The drain pipe adapter 80 is then inserted into the sleeve 48' connecting the longitudinal walls 42',44' of the base member 12'. Preferably, the drain pipe adapter 80 is inserted in the earth-retaining, inward facing longitudinal wall 44' of the base member 12'. The drain pipe adapter 80 is then rotated within the sleeve 48' until the projection overlaps 120 and falls into place with the keyway recess 86 defined by the flange 84 extending outward from the base member 12'. The drain pipe adapter 80 may be secured to the flange 84 in the manner discussed previously, i.e. with mechanical fasteners. The mechanical fasteners may be inserted into the notches 118 formed in the lip member 116 of the drain pipe adapter 80, with the mechanical fasteners extending into the notches 118 in the lip member 116 and into the notches 88 in the flange 84 extending from the base member 12'. Thereafter, the drain pipe 72' may be inserted into the drain pipe adapter 80 until the drain pipe 72' extends through the base member 12' to its intended position, preferably projecting outward from the outward facing longitudinal wall 42' the base member 12'. Additional mechanical fasteners may be inserted into the notches 124 formed in the flange 122 extending from the lip member 116, with the mechanical fasteners inserted directly into the drain pipe 72' to secure the drain pipe adapter 80 to the drain pipe 72'.

With the drain pipe adapter 80 and drain pipe 72' secured in place, the partially assembled headwall 10' may be filled with filler material, such as earth, aggregate, concrete, and the like. If one of the sectional members 14' is positioned on top of the base member 12', the openings 18', 20' defined by the base member 12' and sectional member 14' define an internal space within the headwall 10' that is filled with filler material.

Figure 29:
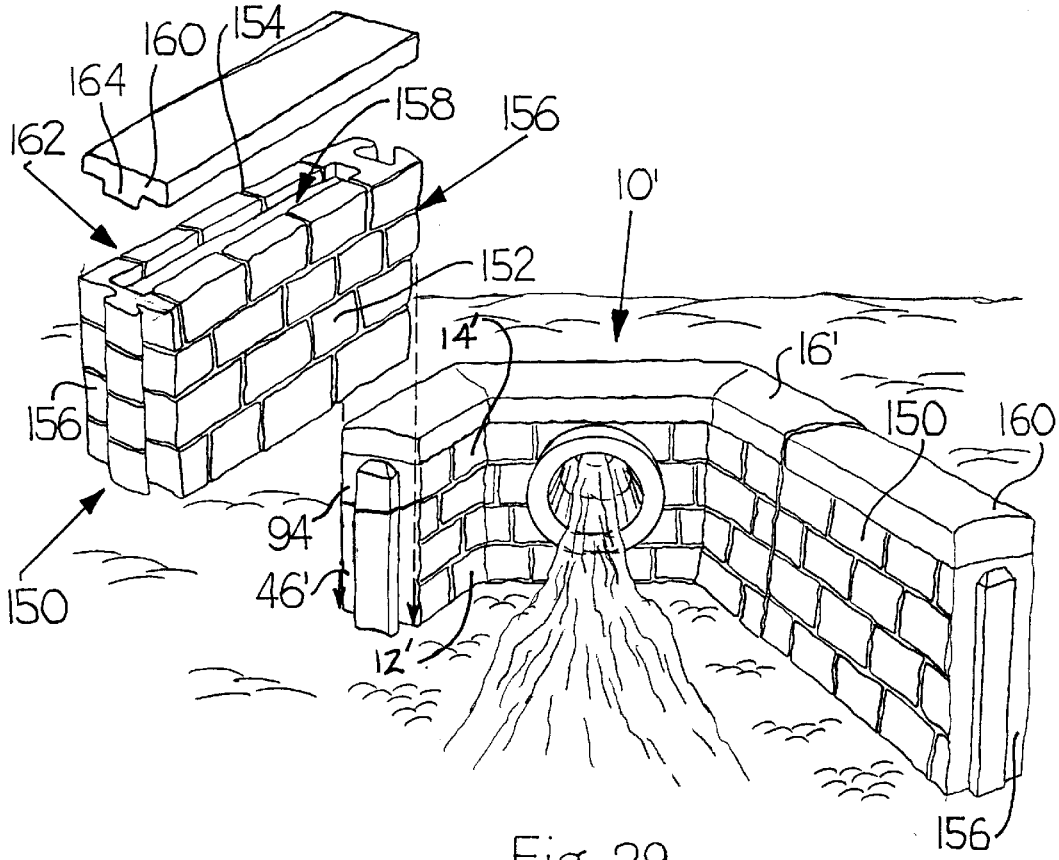
FIG. 29 is a front perspective view of the headwall of FIG. 12 assembled at a construction site, and further showing extension wall members used with the headwall.
Figure 30:
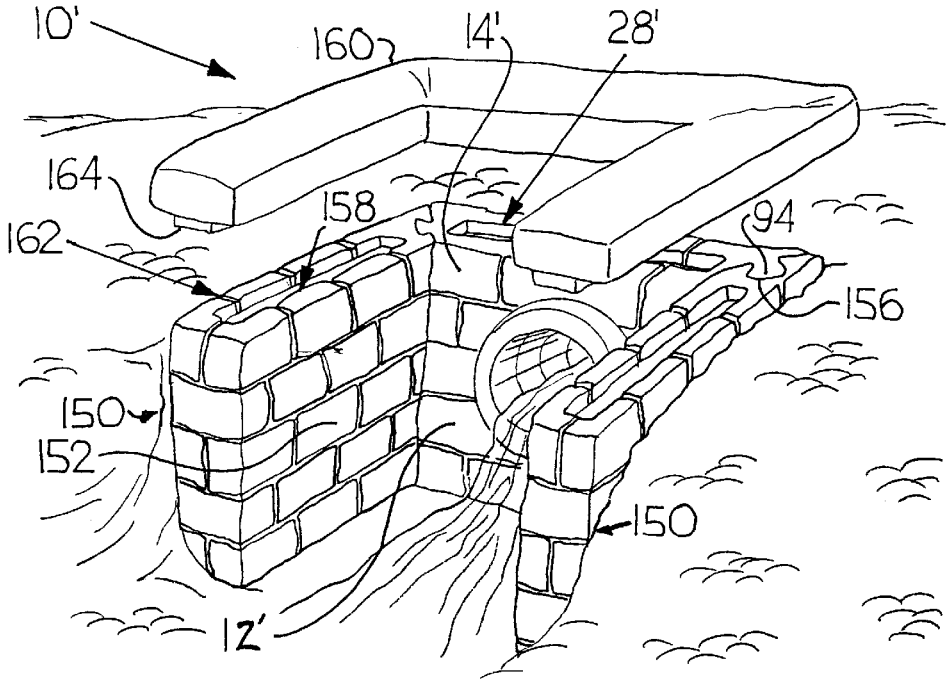
FIG. 30 is a front perspective view of an alternative arrangement for the assembled headwall of FIG. 29.

Two versions of the assembled headwall 10' are shown in FIGS. 29 and 30. FIGS. 29 and 30 show additional features of the headwall 10' of the present invention. The present invention further envisions that one or more unitary wall members 150 may be attached to the end walls 46 of the base member 12' to further extend the headwall 10'. Two wall members 150 are shown in FIGS. 29 and 30. Each of the wall members 150 is a unitary shell member. Each of the wall members 150 includes two longitudinal walls 152,154 and two end walls 156, which define an opening 158 extending through the wall members 150. The wall members 150 may be made of similar materials to the base member 12', sectional member 14', lid member 16', making the wall member 150 as light and easy to manipulate as the other elements of the headwall 10'. The opening 158 extending through the wall members 150 is provided to receive filler material in an analogous manner to the base member 12' and sectional member 14'. The end walls 156 of the wall members 150 and the end walls 46',94 of the base member 12' and sectional member 14' may be configured to connect together to secure the wall members 150 to the respective end walls 46',94 of the base member 12' and sectional member 14'. As shown in FIGS. 29 and 30, a tongue-in-groove connection may be provided to connect the wall members 150 to the base member 12' and the sectional member 14'.

A second lid member 160 is used to enclose a top end 162 of the wall members 150, once the wall members 150 are filled with filler material. As shown in FIG. 29, the second lid member 160 may include a depending projection 164 configured to be received within the opening 158 defined in the wall members 150, preferably in a snap fit, friction fit manner. Alternatively, the lid member 16' used to enclose the top end 36' of the base member 12' or the top end 28' of the section member 14' may be replaced by the second lid member 160, as shown in FIG. 30. The second lid member 160 may be configured as a common lid member 160 used to enclose the top end 36' of the base member 12' or the top end 28' of the sectional member 14' as well as the top end 162 of the wall members 150. FIG. 30 shows the use of multiple wall members 150 with the headwall 10' and the second lid member 160.

Figure 31:
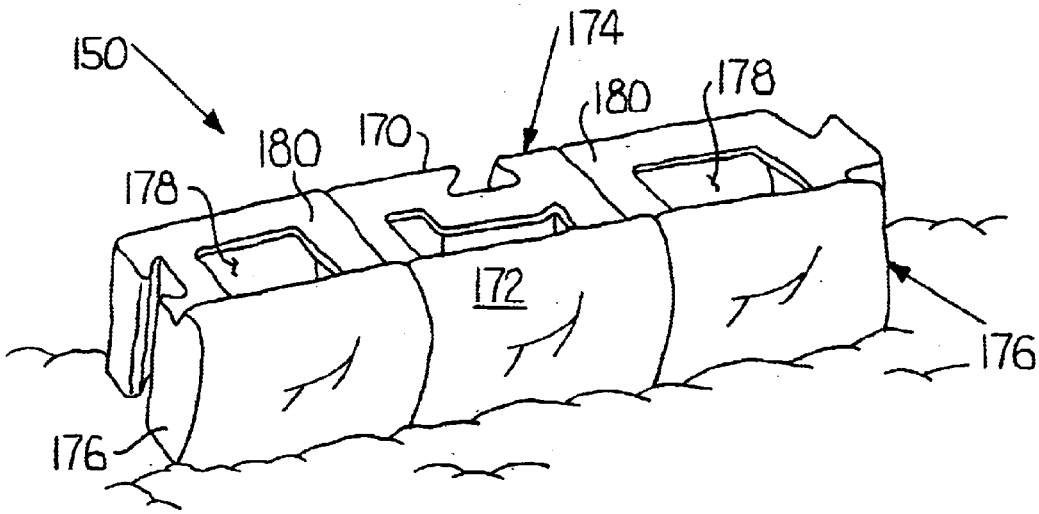
FIG. 31 is a perspective view of an alternative embodiment of the wall member shown in FIGS. 29 and 30.
Figure 32:
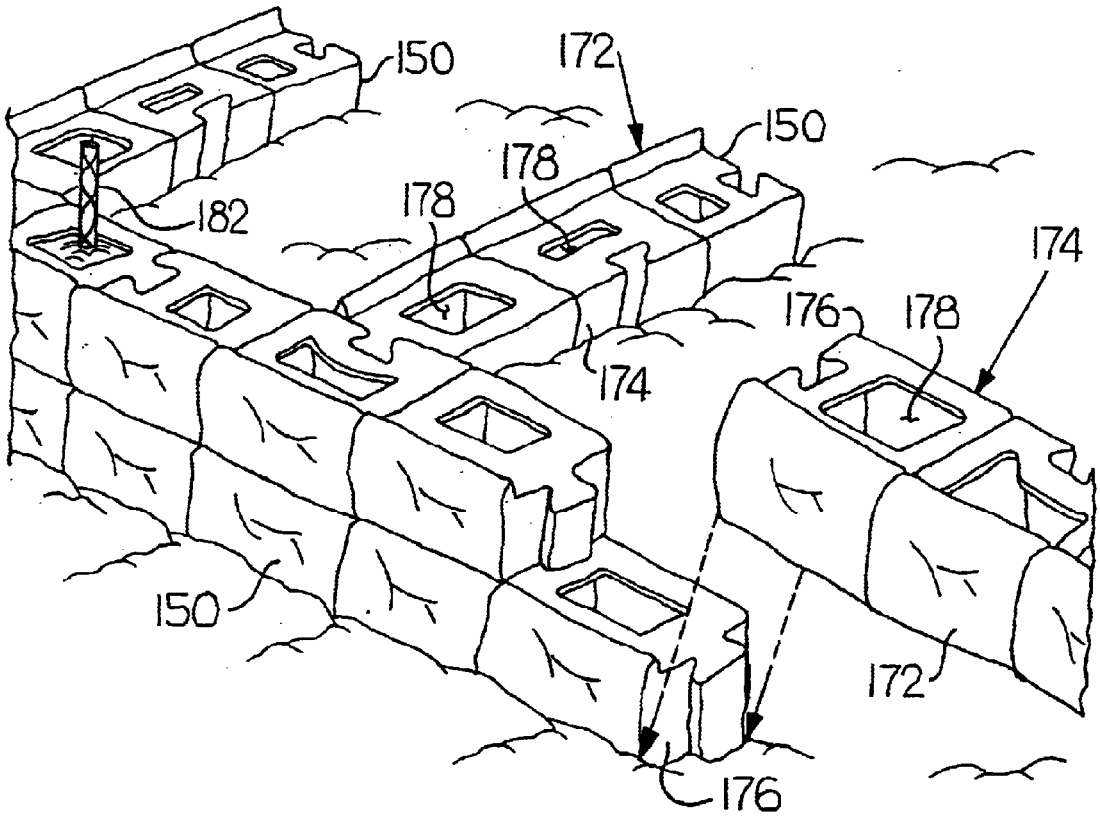
FIG. 32 is a perspective view of the alternative wall member of FIG. 31 showing one construction use for the wall member in accordance with the present invention.

FIGS. 31 and 32 show an alternative embodiment of the wall member 150 discussed hereinabove. The wall member 150 shown in FIG. 31 is formed as a rectangular shaped unitary shell member 170. The shell member 170 is defined by two longitudinal walls 172,174 and two end walls 176. Individual chambers 178 are formed within the shell member 170 by internal partition walls 180. The shell member 170 is preferably formed of plastic material in a similar manner to the base member 12', sectional member 14', lid member 16', and drain pipe adapter 80 discussed previously.

The individual chambers 178 of the shell member 170 are configured to receive filler material. The end walls 176 of the shell member 170 are configured to connect with the end walls 176 of additional shell members 170 to form an earth retaining wall or other structures. One or both of the longitudinal walls 172,174 of the shell member 170 may be configured to connect with the end walls 176 of additional shell member 170, as shown in FIG. 32. In FIG. 32 the end walls 176 and longitudinal walls 172,174 of the various shell members 170 are configured for a tongue-in-groove connection with the end walls 176 and longitudinal walls 172,174 of additional shell members 170.

The wall members 150 shown in FIGS. 31 and 32 may be used for purposes other than earth retaining walls, and are suitable for use as basic building blocks for structures in a manner similar to well known cinder blocks used in the art. Reinforcing bars 182 may be used in connection with the wall members 150 to enhance the structural strength of the wall members 150. Any type of filler material may be used with the wall members 150, including concrete, aggregate, earth fill and the like.

The invention was described herein with reference to preferred embodiments that are merely illustrative of the present invention and not restrictive thereof. Obvious modifications and alterations of the present invention may be made without departing from the spirit and scope of the present invention. The scope of the present invention is defined by the appended claims and equivalents thereto.

I claim:

1. A headwall assembly for supporting a drain pipe, comprising: a unitary base member having two longitudinal walls and two end walls, the longitudinal walls and end walls defining an opening extending through the base member for receiving filler material into the base member, the base member further including a sleeve ending between and connecting the longitudinal walls, and the sleeve defining an aperture extending through the longitudinal walls;

an annular drain pipe adapter configured to be received in the sleeve and having an inner diameter sized to receive the drain pipe; and a unitary lid member configured to engage a top end of the base member and enclose the top end of the base member.

2. The headwall assembly of claim 1, wherein the sleeve connecting the longitudinal walls includes a flange extending outward from one of the longitudinal walls.

3. The headwall assembly of claim 2, wherein the flange extends outward circumferentially around the aperture except in the area of a keyway recess defined by the flange.

4. The headwall assembly of claim 3, wherein the drain pipe adapter includes a lip member configured to cooperate with the flange for connecting the drain pipe adapter to the base member.

5. The headwall assembly of claim 4, wherein the lip member of the drain pipe adapter and the flange extending from the sleeve are configured to be connected together with mechanical fasteners.

6. The headwall assembly of claim 4, wherein the drain pipe adapter includes a projection formed integrally with the lip member and configured to cooperate with the keyway recess for preventing rotational movement of the drain pipe adapter relative to the base member when the drain pipe adapter is inserted into the sleeve.

7. The headwall assembly of claim 6, wherein the drain pipe adapter includes a flange extending from the lip member, with the flange extending from the lip member configured to be connected directly to the drain pipe with mechanical fasteners.

8. The headwall assembly of claim 1, wherein the longitudinal walls of the base member are connected together by a plurality of cone shaped connectors extending from one of the longitudinal walls to the opposing longitudinal wall.

9. The headwall assembly of claim 8, wherein the cone shaped connectors define cone shaped recesses in the surface of the longitudinal wall, and the headwall assembly further includes a plurality of cone shaped plugs configured to engage the recesses defined by the connectors.

10. The headwall assembly of claim 1, wherein the top end of the base member defines a circumferentially extending recess and the lid member includes a depending lip configured to engage the recess such that the lid member snap fits onto the base member.

11. The headwall assembly of claim 1, wherein the base member, the drain pipe adapter, and the lid member are made of plastic.

12. The head wall assembly of claim 1, wherein the lid member includes integrally formed projections for attaching light reflectors to the lid member.

13. The headwall assembly of claim 1, further comprising a unitary wall member configured for attachment to one of the end walls of the base member, with the wall member formed by two longitudinal walls and two end walls defining an opening extending through the wall member for receiving filler material into the wall member.

14. The headwall assembly of claim 13, wherein at least one of the end walls of the wall member and at least one of the end walls of the base member are configured to connect together with a tongue-in-groove connection.

15. The headwall assembly of claim 13, further comprising a second lid member configured to engage a top end of the wall member and enclose the opening extending through the wall member.

16. The headwall assembly of claim 13, wherein the lid member configured to engage the top end of the base member is replaced by a second lid member formed to engage the top end of the base member and a top end of the wall member and enclose the respective openings defined in the base member and the wall member.

17. The headwall assembly of claim 13, wherein the base member, drain pipe adapter, lid member, and the wall member are made of plastic.

18. The headwall assembly of claim 14, wherein the headwall assembly includes a pair of wall members each configured to connect to one of the end walls of the base member.

19. The headwall assembly of claim 18, wherein the end walls of the wall members are configured to connect to the end walls of the base member with tongue-in-groove connections.

20. A headwall assembly for supporting a drain pipe, comprising:

a unitary base member having two longitudinal walls with the longitudinal walls and end walls defining an opening extending through the base member for receiving filler material into the base member with the base member further including a sleeve extending between and connecting the longitudinal walls, with the sleeve defining an aperture extending through the longitudinal walls;

an annular drain pipe adapter configured to be received in the sleeve and having an inner diameter sized to receive the drain pipe;

a unitary sectional member configured to engage a top end of the base member, with the sectional member having two longitudinal walls and two end walls defining an opening extending through the sectional member for receiving filler material into the sectional member; and a unitary lid member configured to engage a top end of the sectional member and enclose the top end of the sectional member.

21. The headwall assembly of claim 20, wherein the sleeve connecting the longitudinal walls of the base member includes a flange extending outward from one of the longitudinal walls of the base member.

22. The headwall assembly of claim 21, wherein the flange extends outward circumferentially around the aperture except in the area of a keyway recess defined by the flange.

23. The headwall assembly of claim 22, wherein the drain pipe adapter includes a lip member configured to cooperate with the flange for connecting the drain pipe adapter to the base member.

24. The headwall assembly of claim 23, wherein the drain pipe adapter includes a projection formed integrally with the lip member and configured to cooperate with the keyway recess for preventing rotational movement of the drain pipe adapter relative to the base member when the drain pipe adapter is inserted into the sleeve.

25. The headwall assembly of claim 20, wherein the longitudinal walls of the base member are connected together by a plurality of cone shaped connectors extending from one of the longitudinal walls of the base member to the opposing longitudinal wall of the base member.

26. The headwall assembly of claim 25, wherein the cone shaped connectors define cone shaped recesses in the surface of one of the longitudinal walls of the base member and the headwall assembly further includes a plurality of cone shaped plugs configured to engage the recesses defined by the connectors.

27. The headwall assembly of claim 20, wherein the top end of the base member defines a circumferentially extending recess and the sectional member includes a depending lip configured to engage the recess defined in the base member such that the sectional member snap fits onto the base member.

28. The headwall of claim 27, wherein the top end of the sectional member defines a circumferentially extending recess and the lid member includes a depending lip configured to engage the recess defined in the sectional member such that the lid member snap fits onto the sectional member.

29. The headwall assembly of claim 20, wherein the base member, drain pipe adapter, sectional member, and lid member are made of plastic.

30. The head wall assembly of claim 20, wherein the lid member includes integrally formed projections for attaching light reflectors to the lid member.

31. The headwall assembly of claim 20, wherein when the sectional member is engaged with the base member, the end walls of the sectional member and base member form common end walls of the headwall assembly, and the headwall assembly further includes a unitary wall member configured for attachment to one of the common end walls of the headwall assembly, with the wall member formed by two longitudinal walls and two end walls defining an opening extending through the wall member for receiving filler material.

32. The headwall assembly of claim 31, wherein at least one of the end walls of the wall member and at least one of the common end walls of the headwall assembly are configured to connect together with a tongue-in-groove connection.

33. A method of constructing a headwall, comprising the steps of:

providing a headwall assembly comprised of a base member and a lid member, with the base member having a ground engaging edge for engaging the ground;

positioning the base member in engagement with the ground along the ground engaging edge of the base member, with the base member having two longitudinal walls and two end walls defining an opening extending through the base member, and with the base member having a sleeve extending between and connecting the longitudinal walls, with the sleeve defining an aperture extending through the longitudinal walls;

extending a drain pipe through the aperture defined by the sleeve;

filling the opening in the base member with filler material; and positioning the lid member on the base member such that the headwall is formed and a top end of the base member is enclosed.

34. The method of claim 33, wherein the headwall assembly further includes at least one sectional member configured to engage the top end of the base member, with the method further comprising the steps of:

placing the sectional member in engagement with the top end of the base member, with the sectional member including two longitudinal walls and two end walls defining an opening extending through the sectional member and cooperating with the opening defined by the base member; and positioning the lid member on top of the sectional member such that the headwall is formed and a top end of the sectional member is enclosed.

35. The method of claim 33, wherein the headwall further includes an annular drain pipe adapter configured to be received in the sleeve and having an inner diameter sized to receive the drain pipe, with the method further comprising the steps of:

inserting the drain pipe adapter into the sleeve; and extending a drain pipe through the annular drain pipe adapter.

36. The method of claim 35, wherein the sleeve includes a flange extending outward from one of the longitudinal walls of the base member, with the flange extending circumferentially around the aperture defined by the sleeve except in the area of a keyway recess defined by the flange, and wherein the drain pipe adapter includes a lip member configured to cooperate with the flange, with the lip member having an integrally formed projection configured to cooperate with the keyway recess, the method further comprising the step of inserting the drain pipe adapter into the sleeve such that the lip member cooperates with he flange and the projection is received in the keyway thereby preventing rotational movement of the drain pipe adapter relative to the base member.

37. A headwall assembly for supporting a drain pipe, comprising:

a unitary base member having two longitudinal walls and two end walls, the longitudinal walls and end walls defining an opening extending through the base member for receiving filler material into the base member, the base member further including a sleeve ending between and connecting the longitudinal walls, and the sleeve defining an aperture extending through the longitudinal walls; and a unitary lid member configured to engage a top end of the base member and enclose the top end of the base member, wherein one of the lid member and base member comprises a male connecting member configured to cooperate with a female connecting member formed in the other of the lid member and base member to connect the lid member to the base member.

38. The headwall assembly of claim 37, wherein at least one of the base member and lid member has at least one light reflector attached thereto.

39. The headwall assembly of claim 37, wherein at least one of the base member and lid member is made of light absorbing and emitting plastic.

40. The headwall assembly of claim 37, wherein the lid member comprises at least one integrally formed projection.

41. The headwall assembly of claim 40, further comprising at least one light reflector attached to the at least one projection.

42. The headwall assembly of claim 40, further comprising at least one delineator bar attached to the at least one projection.

43. The headwall assembly of claim 42, further comprising at least one light reflector attached to the at least one delineator bar.

44. The headwall assembly of claim 37, wherein the male connecting member is formed by a recess defined at the top end of the base member.

45. The headwall assembly of claim 37, wherein the male connecting member comprises a depending lip formed at a bottom end of the lid member, and the female connecting member comprises a recess defined at the top end of the base member.

46. The headwall assembly of claim 37, wherein the longitudinal walls of the base member are connected together by a plurality of cone shaped connectors extending from one of the longitudinal walls to the opposing longitudinal wall.

47. The headwall assembly of claim 46, wherein the cone shaped connectors define cone shaped recesses in the surface of the longitudinal wall, and the headwall assembly further includes a plurality of cone shaped plugs configured to engage the recesses defined by the connectors.

48. The headwall assembly of claim 37, wherein the base member and lid member are made of plastic.

49. The headwall assembly of claim 37, further comprising a unitary wall member configured for attachment to one of the end walls of the base member, with the wall member formed by two longitudinal walls and two end walls defining an opening extending through the wall member for receiving filler material into the wall member.

50. The headwall assembly of claim 49, wherein at least one of the end walls of the wall member and at least one of the end walls of the base member are configured to connect together with a tongue-in-groove connection.

51. The headwall assembly of claim 49, further comprising a second lid member configured to engage a top end of the wall member and enclose the opening extending through the wall member.

52. The headwall assembly of claim 49, wherein the lid member configured to engage the top end of the base member is replaced by a second lid member formed to engage the top end of the base member and a top end of the wall member and enclose the respective openings defined in the base member and the wall member.

53. The headwall assembly of claim 50, wherein the headwall assembly includes a pair of wall members each configured to connect to one of the end walls of the base member.

54. The headwall assembly of claim 53, wherein the end walls of the wall members are configured to connect to the end walls of the base member with tongue-in-groove connections.

* * * * *